US012274328B2

(12) United States Patent
Walker et al.

(10) Patent No.: US 12,274,328 B2
(45) **Date of Patent: *Apr. 15, 2025**

(54) FOOTWEAR INCLUDING AN INCLINE ADJUSTER

(71) Applicant: NIKE, Inc., Beaverton, OR (US)

(72) Inventors: Steven H. Walker, Camas, WA (US); Raymond L. Nicoli, Seattle, WA (US); Rolando Pausal, Kirkland, WA (US)

(73) Assignee: NIKE, Inc., Beaverton, OR (US)

( * ) Notice: Subject to any disclaimer, the term of this patent is extended or adjusted under 35 U.S.C. 154(b) by 108 days.

This patent is subject to a terminal disclaimer.

(21) Appl. No.: 17/993,741

(22) Filed: Nov. 23, 2022

(65) Prior Publication Data

US 2023/0087070 A1 Mar. 23, 2023

Related U.S. Application Data

(63) Continuation of application No. 17/207,094, filed on Mar. 19, 2021, now Pat. No. 11,576,464, which is a (Continued)

(51) Int. Cl.
*A43B 13/18* (2006.01)
*A43B 3/24* (2006.01)

(Continued)

(52) U.S. Cl.
CPC ..... *A43B 3/246* (2013.01); *A43B 3/34* (2022.01); *A43B 5/06* (2013.01); *A43B 5/10* (2013.01);

(Continued)

(58) Field of Classification Search
CPC ... A43B 13/186; A43B 13/187; A43B 13/189; A43B 13/20; A43B 13/206; A43B 7/24;

(Continued)

(56) References Cited

U.S. PATENT DOCUMENTS 3,906,185 A 9/1975 Gross et al.
4,183,156 A 1/1980 Rudy (Continued)

FOREIGN PATENT DOCUMENTS

CN 1153622 A 7/1997
CN 1185721 A 6/1998

(Continued)

OTHER PUBLICATIONS

Demon, Ronald, "Black History in America" Internet Archive Wayback Machine, http://www.myblackhistor.net/Ronald_Demon.htm, pp. 1-2.

(Continued)

*Primary Examiner* — Ted Kavanaugh
(74) *Attorney, Agent, or Firm* — Banner & Witcoff, Ltd.

(57) ABSTRACT

A sole structure may include chambers and a transfer channel containing an electrorheological fluid. Electrodes may be positioned to create, in response to a voltage across the electrodes, an electrical field in at least a portion of the electrorheological fluid in the transfer channel. The sole structure may further include a controller including a processor and memory. At least one of the processor and memory may store instructions executable by the processor to perform operations that include maintaining the voltage across the electrodes at one or more flow-inhibiting levels at which flow of the electrorheological fluid the through the transfer channel is blocked, and that further include maintaining the voltage across the electrodes at one or more flow-enabling levels permitting flow of the electrorheological fluid through the transfer channel.

20 Claims, 19 Drawing Sheets

Related U.S. Application Data continuation of application No. 16/119,084, filed on Aug. 31, 2018, now Pat. No. 10,980,312.

(60) Provisional application No. 62/552,548, filed on Aug. 31, 2017.

(51) Int. Cl.

| | |
|---|---|
| ***A43B 3/34*** | (2022.01) |
| ***A43B 5/06*** | (2022.01) |
| ***A43B 5/10*** | (2006.01) |
| ***A43B 7/24*** | (2006.01) |
| ***A43B 13/04*** | (2006.01) |
| ***A43B 13/14*** | (2006.01) |

(52) U.S. Cl.

CPC ..... *A43B 7/24* (2013.01); *A43B 13/04* (2013.01); *A43B 13/143* (2013.01); *A43B 13/189* (2013.01); *A43B 13/187* (2013.01); *A43B 13/188* (2013.01)

(58) Field of Classification Search

CPC ..... A43B 5/06; A43B 3/0015; A43B 3/0005; A43B 3/34

See application file for complete search history.

(56) References Cited

U.S. PATENT DOCUMENTS

| | | | | |
|---|---|---|---|---|
| 4,219,945 | A | 9/1980 | Rudy | |
| 4,471,538 | A | 9/1984 | Pomeranz et al. | |
| 4,651,443 | A | 3/1987 | Eckstrom | |
| 4,898,084 | A | 2/1990 | Oppermann et al. | |
| 4,923,057 | A | 5/1990 | Carlson et al. | |
| 4,952,868 | A | 8/1990 | Scherer, III | |
| 4,999,931 | A | 3/1991 | Vermeulen | |
| 5,222,312 | A | 6/1993 | Doyle | |
| 5,335,382 | A | 8/1994 | Huang | |
| 5,493,792 | A | 2/1996 | Bates et al. | |
| 5,686,167 | A | 11/1997 | Rudy | |
| 5,771,606 | A | 6/1998 | Litchfield et al. | |
| 5,794,366 | A | 8/1998 | Chien | |
| 5,813,142 | A | 9/1998 | Demon | |
| 5,896,682 | A | 4/1999 | Lin | |
| 5,921,009 | A | 7/1999 | Hice | |
| 5,979,086 | A | 11/1999 | Vindriis | |
| 6,138,382 | A | 10/2000 | Schoesler | |
| 6,378,558 | B1 | 4/2002 | Pohl et al. | |
| 6,519,873 | B1 * | 2/2003 | Buttigieg | A43B 3/108 36/29 |
| 6,812,624 | B1 | 11/2004 | Pei et al. | |
| 6,845,573 | B2 | 1/2005 | Litchfield et al. | |
| 6,889,451 | B2 | 5/2005 | Passke et al. | |
| 6,971,193 | B1 | 12/2005 | Potter et al. | |
| 7,007,412 | B2 | 3/2006 | Munster | |
| 7,200,956 | B1 | 4/2007 | Kotha et al. | |
| 7,204,041 | B1 | 4/2007 | Bailey, Sr. et al. | |
| 7,219,449 | B1 | 5/2007 | Hoffberg et al. | |
| 7,254,908 | B2 | 8/2007 | Ungari | |
| 7,409,779 | B2 | 8/2008 | Dojan et al. | |
| 7,950,169 | B2 | 5/2011 | Holt et al. | |
| 8,234,800 | B2 | 8/2012 | Buder et al. | |
| 8,302,327 | B2 | 11/2012 | Battlogg | |
| 8,973,613 | B2 | 3/2015 | Murphy et al. | |
| 9,107,475 | B2 | 8/2015 | Ellis | |
| 9,271,538 | B2 | 3/2016 | Ellis | |
| 9,820,531 | B2 | 11/2017 | Walker et al. | |
| 10,980,312 | B2 * | 4/2021 | Walker | A43B 13/189 |
| 10,980,314 | B2 * | 4/2021 | Walker | A43B 3/34 |
| 11,096,445 | B2 * | 8/2021 | Walker | A43B 3/246 |
| 11,576,464 | B2 * | 2/2023 | Walker | A43B 3/246 |
| 11,666,116 | B2 * | 6/2023 | Walker | A43B 3/246 36/25 R |
| 2002/0133237 | A1 | 9/2002 | Christesen | |
| 2003/0056401 | A1 | 3/2003 | Kwon | |
| 2003/0101619 | A1 | 6/2003 | Litchfield et al. | |
| 2003/0154628 | A1 | 8/2003 | Gyr | |
| 2004/0002665 | A1 | 1/2004 | Parihar et al. | |
| 2004/0003515 | A1 | 1/2004 | Marvin et al. | |
| 2004/0154190 | A1 | 8/2004 | Munster | |
| 2004/0177531 | A1 | 9/2004 | DiBenedetto et al. | |
| 2004/0211085 | A1 | 10/2004 | Passke et al. | |
| 2005/0183292 | A1 | 8/2005 | DiBenedetto et al. | |
| 2005/0268487 | A1 | 12/2005 | Ellis | |
| 2006/0143645 | A1 | 6/2006 | Vock et al. | |
| 2006/0248749 | A1 | 11/2006 | Ellis | |
| 2006/0248750 | A1 | 11/2006 | Rosenberg | |
| 2007/0000154 | A1 | 1/2007 | DiBenedetto et al. | |
| 2007/0006489 | A1 | 1/2007 | Case et al. | |
| 2008/0083140 | A1 | 4/2008 | Ellis | |
| 2008/0245985 | A1 | 10/2008 | Heim et al. | |
| 2009/0200501 | A1 | 8/2009 | Heim et al. | |
| 2009/0235557 | A1 | 9/2009 | Christensen et al. | |
| 2009/0248760 | A1 | 10/2009 | Tone et al. | |
| 2010/0251574 | A1 | 10/2010 | Battlogg et al. | |
| 2011/0107622 | A1 | 5/2011 | Schwirian | |
| 2011/0251536 | A1 | 10/2011 | Wilford et al. | |
| 2012/0174432 | A1 | 7/2012 | Peyton | |
| 2012/0273053 | A1 | 11/2012 | Murphy et al. | |
| 2012/0291564 | A1 | 11/2012 | Amos et al. | |
| 2013/0019694 | A1 | 1/2013 | Molyneux et al. | |
| 2013/0185003 | A1 | 7/2013 | Carbeck et al. | |
| 2013/0213147 | A1 | 8/2013 | Rice et al. | |
| 2013/0278436 | A1 | 10/2013 | Ellis | |
| 2014/0033572 | A1 | 2/2014 | Steier et al. | |
| 2014/0053427 | A1 | 2/2014 | Patton | |
| 2014/0068973 | A1 | 3/2014 | Krupenkin et al. | |
| 2014/0250726 | A1 | 9/2014 | Meschter | |
| 2014/0277632 | A1 | 9/2014 | Walker | |
| 2015/0157091 | A1 | 6/2015 | Hsu | |
| 2015/0177081 | A1 | 6/2015 | Steier | |
| 2016/0235160 | A1 * | 8/2016 | Lam | A43B 13/188 |
| 2016/0344309 | A1 * | 11/2016 | Otagiri | A43B 3/38 |
| 2016/0345663 | A1 * | 12/2016 | Walker | A43B 5/10 |
| 2016/0345669 | A1 | 12/2016 | Orand et al. | |
| 2016/0345670 | A1 | 12/2016 | Orand | |
| 2016/0367192 | A1 | 12/2016 | Iyengar et al. | |
| 2017/0071287 | A1 | 3/2017 | Kim | |
| 2017/0106940 | A1 | 4/2017 | Paick | |
| 2017/0150779 | A1 | 6/2017 | Walker et al. | |
| 2017/0150780 | A1 | 6/2017 | Walker et al. | |
| 2017/0150785 | A1 * | 6/2017 | Walker | A43B 13/20 |
| 2017/0348181 | A1 | 12/2017 | Perriard et al. | |
| 2018/0035752 | A1 | 2/2018 | Walker et al. | |
| 2018/0132566 | A1 | 5/2018 | Rosenblatt et al. | |
| 2019/0059511 | A1 | 2/2019 | Walker et al. | |
| 2019/0059514 | A1 | 2/2019 | Walker et al. | |
| 2019/0110551 | A1 | 4/2019 | Walker | |

FOREIGN PATENT DOCUMENTS

| | | | |
|---|---|---|---|
| CN | 101675836 | A | 3/2010 |
| CN | 101708087 | A | 5/2010 |
| CN | 101766363 | A | 7/2010 |
| CN | 101978918 | A | 2/2011 |
| CN | 201929109 | U | 8/2011 |
| CN | 102341149 | A | 2/2012 |
| CN | 102595949 | A | 7/2012 |
| CN | 202286561 | U | 7/2012 |
| CN | 103776461 | A | 5/2014 |
| CN | 104146850 | A | 11/2014 |
| CN | 104270981 | A | 1/2015 |
| CN | 104507342 | A | 4/2015 |
| CN | 104640467 | A | 5/2015 |
| CN | 204580030 | U | 8/2015 |
| CN | 105231582 | A | 1/2016 |
| CN | 105266256 | A | 1/2016 |
| CN | 105631195 | A | 6/2016 |
| CN | 105815866 | A | 8/2016 |
| CN | 205568003 | U | 9/2016 |
| CN | 106063607 | A | 11/2016 |
| CN | 106136419 | A | 11/2016 |
| CN | 206025343 | U | 3/2017 |
| CN | 106595912 | A | 4/2017 |

(56) References Cited

FOREIGN PATENT DOCUMENTS

| | | | |
|---|---|---|---|
| CN | 107003188 | A | 8/2017 |
| DE | 10240530 | A1 | 3/2004 |
| EP | 0211283 | A1 | 2/1987 |
| EP | 1210883 | A1 | 6/2002 |
| EP | 2774502 | A1 | 9/2014 |
| FR | 2973656 | A1 | 10/2012 |
| JP | H11117985 | A | 4/1999 |
| JP | 200015646 | A | 1/2000 |
| JP | 2005279281 | A | 10/2005 |
| JP | 2009540237 | A | 11/2009 |
| JP | 2013215530 | A | 10/2013 |
| KR | 20130048669 | A | 5/2013 |
| KR | 20130068881 | A | 6/2013 |
| TW | 453151 | U | 9/2001 |
| WO | 93012685 | A1 | 7/1993 |
| WO | 9835529 | A2 | 8/1998 |
| WO | 0178539 | A2 | 10/2001 |
| WO | 2007125148 | A1 | 11/2007 |
| WO | 2012112931 | A2 | 8/2012 |
| WO | 2014138020 | A1 | 9/2014 |
| WO | 2016075599 | A1 | 5/2016 |
| WO | 2016191204 | A1 | 12/2016 |
| WO | 2017095850 | A1 | 6/2017 |

OTHER PUBLICATIONS

Vieroth, et al., Stretchable Circuit Board Technology and Application, Wearable Computers, 2009 ISWC '09, International Symposium. Sep. 7, 2009 (Sep. 7, 2009), pp. 33-36, XP055351553, Piscataway, NJ, USA, DOI: 10.1109/ISWC.2009.13, ISBN: 978-0-7695-3779-5, sentences 3-5, 20-21, paragraph 2.2.

Sep. 19, 2016—(WO) ISR & WO—App. No. PCT/US16/033899.

Feb. 17, 2017—(WO) ISR & WO—App. No. PCT/US16/064068.

Mar. 15, 2017—(WO) ISR & WO—App. No. PCT/US16/064084.

Nov. 6, 2018—(WO) ISR & WO—App. No. PCT/US18/048719.

* cited by examiner

FOOTWEAR INCLUDING AN INCLINE ADJUSTER

CROSS REFERENCE TO RELATED APPLICATION

This application is a continuation of U.S. patent application Ser. No. 17/207,094 titled "FOOTWEAR INCLUDING AN INCLINE ADJUSTER," filed on Mar. 19, 2021, which is a continuation of U.S. patent application Ser. No. 16/119,084 titled "FOOTWEAR INCLUDING AN INCLINE ADJUSTER," filed Aug. 31, 2018, which claims priority to U.S. Provisional Patent Application No. 62/552,548, titled "FOOTWEAR INCLUDING AN INCLINE ADJUSTER," and filed Aug. 31, 2017, each of which are incorporated by reference herein in their entirety.

BACKGROUND

Conventional articles of footwear generally include an upper and a sole structure. The upper provides a covering for the foot and securely positions the foot relative to the sole structure. The sole structure is secured to a lower portion of the upper and is configured so as to be positioned between the foot and the ground when a wearer is standing, walking, or running.

Conventional footwear is often designed with the goal of optimizing a shoe for a particular condition or set of conditions. For example, sports such as tennis and basketball require substantial side-to-side movements. Shoes designed for wear while playing such sports often include substantial reinforcement and/or support in regions that experience more force during sideways movements. As another example, running shoes are often designed for forward movement by a wearer in a straight line. Difficulties can arise when a shoe must be worn during changing conditions, or during multiple different types of movements.

SUMMARY

This Summary is provided to introduce a selection of concepts in a simplified form that are further described below in the Detailed Description. This Summary is not intended to identify key features or essential features of the invention.

In at least some embodiments, an incline adjuster may include a variable-volume lateral chamber and a variable-volume medial chamber. The incline adjuster may further include a transfer channel extending between the lateral chamber and the medial chamber, an electrorheological fluid filling the lateral chamber, the transfer channel, and the medial chamber, and opposing electrodes exposed to the electrorheological fluid along the transfer channel. The electrodes may be formed from, e.g., metal sheet or conductive rubber.

In some embodiments, an incline adjuster may include a variable-volume first chamber and a variable-volume second chamber. The incline adjuster may further include a transfer extending between the first chamber and the second chamber, an electrorheological fluid filling the first chamber, the transfer channel, and the second chamber, and opposing electrodes exposed to the electrorheological fluid along the transfer channel. The first chamber may include a flexible first chamber wall that further includes a first chamber wall central section and a first chamber wall side section surrounding the first chamber wall central section. The first chamber wall side section may include at least one fold defining a bellows shape of the first chamber.

In some embodiments, a method of fabricating an incline adjuster may include molding a first component in which first portions of medial and lateral chambers and a first portion of a transfer channel are defined therein, and in which a portion of a first electrode is exposed along the first portion of the transfer channel. The method may also include molding a second component in which second portions of medial and lateral chambers and a second portion of a transfer channel are defined therein, and in which a portion of a second electrode is exposed along the second portion of the transfer channel. The method may additionally include bonding the first component to the second component to create an incline adjuster in which the first and second portions of the medial chamber are combined to form the medial chamber, the first and second portions of the lateral chamber are combined to form the lateral chamber, the first and second portions of the transfer channel are combined to form the transfer channel, and the transfer channel connects the medial and lateral chambers.

Additional embodiments are described herein.

BRIEF DESCRIPTION OF THE DRAWINGS

Some embodiments are illustrated by way of example, and not by way of limitation, in the figures of the accompanying drawings and in which like reference numerals refer to similar elements.

DETAILED DESCRIPTION

Figure 1:
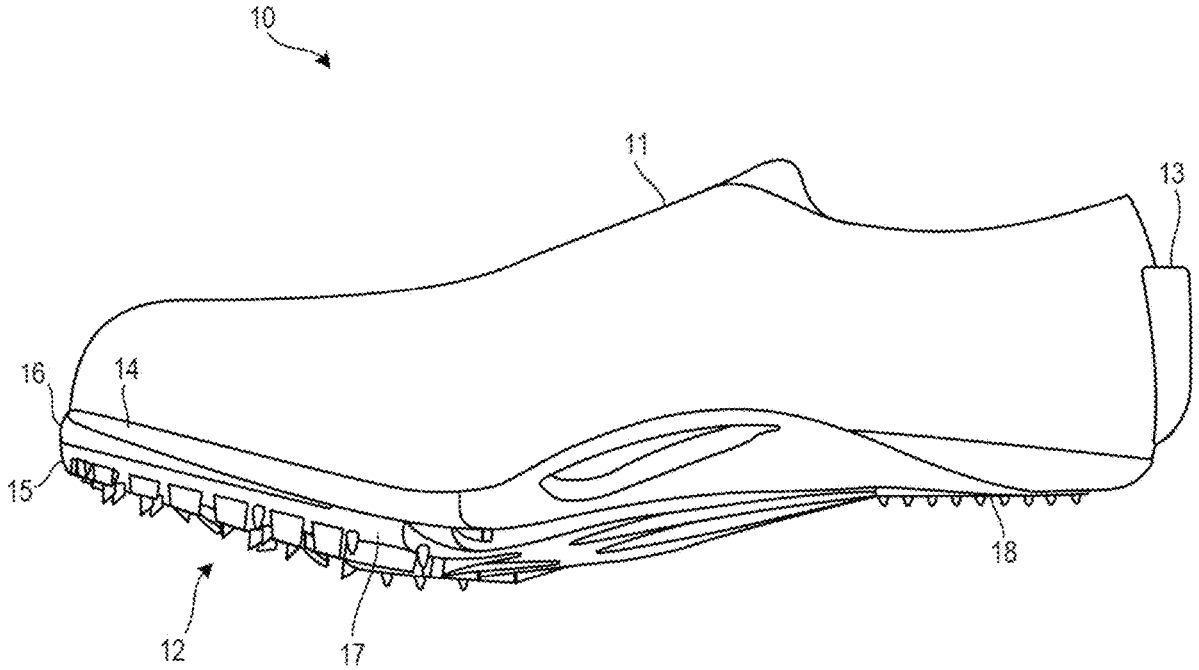
FIG. 1 is a medial side view of a shoe according to some embodiments.

In various types of activities, it may be advantageous to change the shape of a shoe or shoe portion while a wearer of that shoe is running or otherwise participating in the activity. In many running competitions, for example, athletes race around a track having curved portions, also known as "bends." In some cases, particularly shorter events such as 200 meter or 400 meter races, athletes may be running at sprint paces on a track bend. Running on a flat curve at a fast pace is biomechanically inefficient, however, and may require awkward body movements. To counteract such effects, bends of some running tracks are banked. This banking allows more efficient body movement and typically results in faster running times. Tests have shown that similar advantages can be achieved by altering the shape of a shoe. In particular, running on a flat track bend in a shoe having a footbed that is inclined relative to the ground can mimic the benefits of running on a banked bend in a shoe having a non-inclined footbed. However, an inclined footbed is a disadvantage on straight portions of a running track. Footwear that can provide an inclined footbed when running on a bend and reduce or eliminate the incline when running on a straight track section would offer a significant advantage.

In footwear according to some embodiments, electrorheological (ER) fluid is used to change the shape of one or more shoe portions. ER fluids typically comprise a non-conducting oil or other fluid in which very small particles are suspended. In some types of ER fluid, the particles may be have diameters of 5 microns or less and may be formed from polystyrene or another polymer having a dipolar molecule. When an electric field is imposed across the ER fluid, the viscosity of the fluid increases as the strength of that field increases. As described in more detail below, this effect can be used to control transfer of fluid and modify the shape of a footwear component. Although track shoe embodiments are initially described, other embodiments include footwear intended for other sports or activities.

"Shoe" and "article of footwear" are used interchangeably herein to refer to an article intended for wear on a human foot. A shoe may or may not enclose the entire foot of a wearer. For example, a shoe could include a sandal-like upper that exposes large portions of a wearing foot. Shoe elements can be described based on regions and/or anatomical structures of a human foot wearing that shoe, and by assuming that the interior of the shoe generally conforms to and is otherwise properly sized for the wearing foot. A forefoot region of a foot includes the heads and bodies of the metatarsals, as well as the phalanges. A forefoot element of a shoe is an element having one or more portions located under, over, to the lateral and/or medial side of, and/or in front of a wearer's forefoot (or portion thereof) when the shoe is worn. A midfoot region of a foot includes the cuboid, navicular, and cuneiforms, as well as the bases of the metatarsals. A midfoot element of a shoe is an element having one or more portions located under, over, and/or to the lateral and/or medial side of a wearer's midfoot (or portion thereof) when the shoe is worn. A heel region of a foot includes the talus and the calcaneus. A heel element of a shoe is an element having one or more portions located under, to the lateral and/or medial side of, and/or behind a wearer's heel (or portion thereof) when the shoe is worn. The forefoot region may overlap with the midfoot region, as may the midfoot and heel regions.

FIG. 1 is a medial side view of a track shoe 10 according to some embodiments. The lateral side of shoe 10 has a similar configuration and appearance, but is configured to correspond to a lateral side of a wearer foot. Shoe 10 is configured for wear on a right foot and is part of a pair that includes a shoe (not shown) that is a mirror image of shoe 10 and is configured for wear on a left foot. As explained in more detail below, however, shoe 10 and its corresponding left shoe may be configured to alter their shapes in different ways under a given set of conditions.

Shoe 10 includes an upper 11 attached to a sole structure 12. Upper 11 may be formed from any of various types or materials and have any of a variety of different constructions. In some embodiments, for example, upper 11 may be knitted as a single unit and may not include a bootie of other type of liner. In some embodiments, upper 11 may be slip lasted by stitching bottom edges of upper 11 to enclose a foot-receiving interior space. In other embodiments, upper 11 may be lasted with a strobel or in some other manner. A battery assembly 13 is located in a rear heel region of upper 11 and includes a battery that provides electrical power to a controller. The controller is not visible in in FIG. 1, but is described below in connection with other drawing figures.

Sole structure 12 includes a footbed 14, an outsole 15, and an incline adjuster 16. Incline adjuster 16 is situated between outsole 15 and footbed 14 in a forefoot region. As explained in more detail below, incline adjuster 16 includes a medial side fluid chamber that supports a medial forefoot portion of footbed 14, as well as a lateral side fluid chamber that supports a lateral forefoot portion of footbed 14. ER fluid may be transferred between those chambers through a connecting transfer channel that is in fluid communication with the interiors of both chambers. That fluid transfer may raise the height of one chamber relative to the other chamber, resulting in an incline in a portion of footbed 14 located over the chambers. When further flow of ER fluid through the channel is interrupted, the incline is maintained until ER fluid flow is allowed to resume.

Figure 2A:
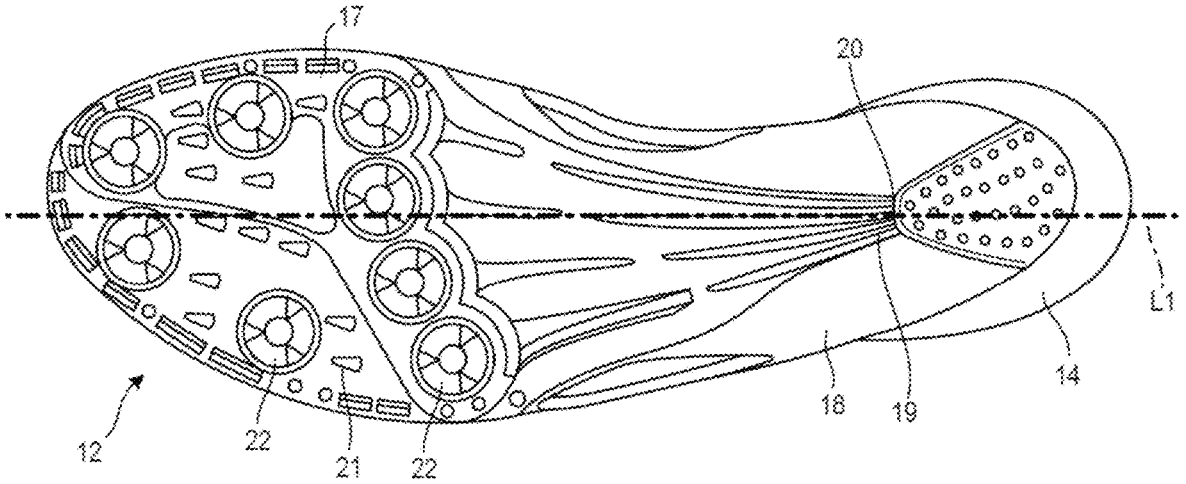
FIG. 2A is a bottom view of the sole structure of the shoe of FIG. 1.
Figure 2B:
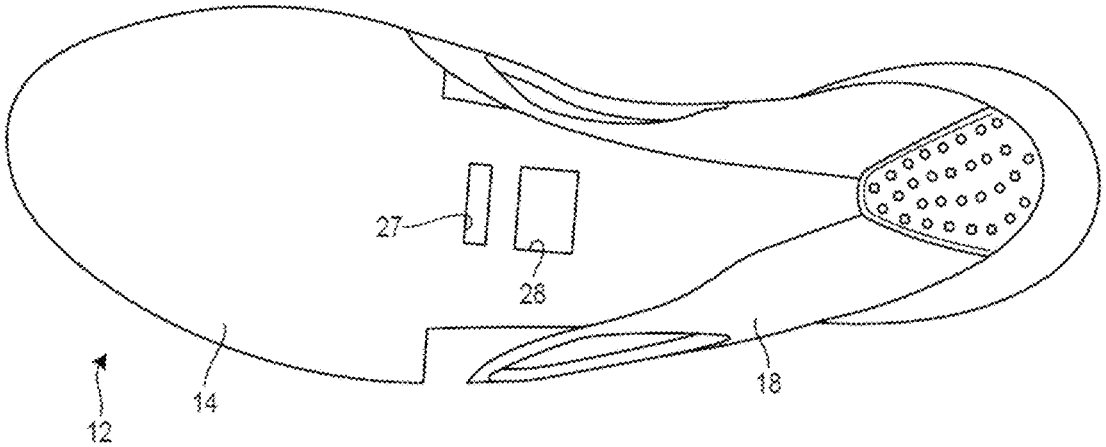
FIG. 2B is a bottom view of the sole structure of the shoe of FIG. 1, but with a forefoot outsole element removed.
Figure 2C:
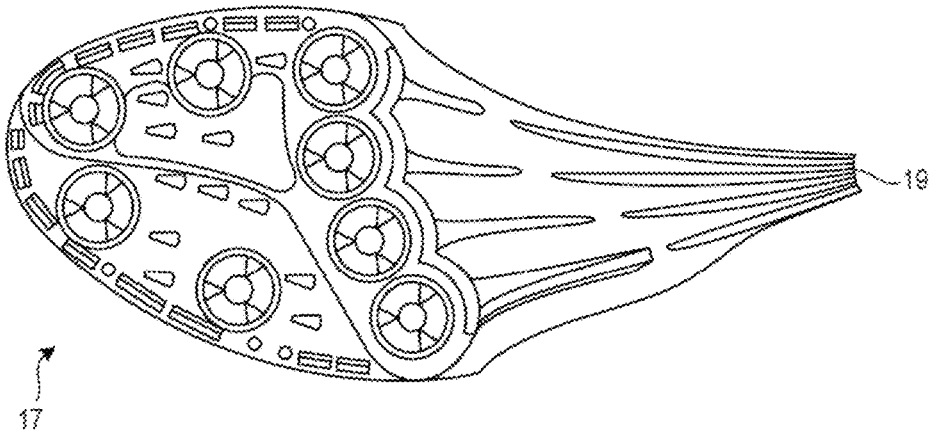
FIG. 2C is a bottom view of the forefoot outsole element of the sole structure of the shoe of FIG. 1.

Outsole 15 forms the ground-contacting portion of sole structure 12. In the embodiment of shoe 10, outsole 15 includes a forward outsole section 17 and a rear outsole section 18. The relationship of forward outsole section 17 and rear outsole section 18 can be seen by comparing FIG. 2A, a bottom view of sole structure 12, and FIG. 2B, a bottom view of sole structure 12 with forefoot outsole section 17 removed. FIG. 2C is a bottom view of forefoot outsole section 17 removed from sole structure 12. As seen in FIG. 2A, forward outsole section 17 extends through forefoot and central midfoot regions of sole structure 12 and tapers to a narrowed end 19. End 19 is attached to rear outsole section 18 at a joint 20 located in the heel region. Rear outsole section 18 extends over side midfoot regions and over the heel region and is attached to footbed 14. Forward outsole section 17 is also coupled to footbed 14 by a fulcrum element and by the above-mentioned fluid chambers of incline adjuster 16. Forefoot outsole section 17 pivots about a longitudinal axis L1 passing through joint 20 and through the forefoot fulcrum element. In particular, and as explained below, forefoot outsole section 17 rotates about axis L1 as a forefoot portion of footbed 14 inclines relative to forefoot outsole section 17.

Outsole 15 may be formed of a polymer or polymer composite and may include rubber and/or other abrasion-resistant material on ground-contacting surfaces. Traction elements 21 may be molded into or otherwise formed in the bottom of outsole 15. Forefoot outsole section 17 may also include receptacles to hold one or more removable spike elements 22. In other embodiments, outsole 15 may have a different configuration.

Footbed 14 includes a midsole 25. In the embodiment of shoe 10, midsole 25 has a size and a shape approximately corresponding to a human foot outline, is a single piece that extends the full length and width of footbed 14, and includes a contoured top surface 26 (shown in FIG. 3). The contour of top surface 26 is configured to generally correspond to the shape of the plantar region of a human foot and to provide arch support. Midsole 25 may be formed from ethylene vinyl acetate (EVA) and/or one or more other closed cell polymer foam materials. Midsole 25 may also have pockets 27 and 28 formed therein to house a controller and other electronic components, as described below. Upwardly extending medial and lateral sides of rear outsole section 18 may also provide additional medial and lateral side support to a wearer foot. In other embodiments, a footbed may have a different configuration, e.g., a midsole may cover less than all of a footbed or may be entirely absent, and/or a footbed may include other components.

Figure 3:
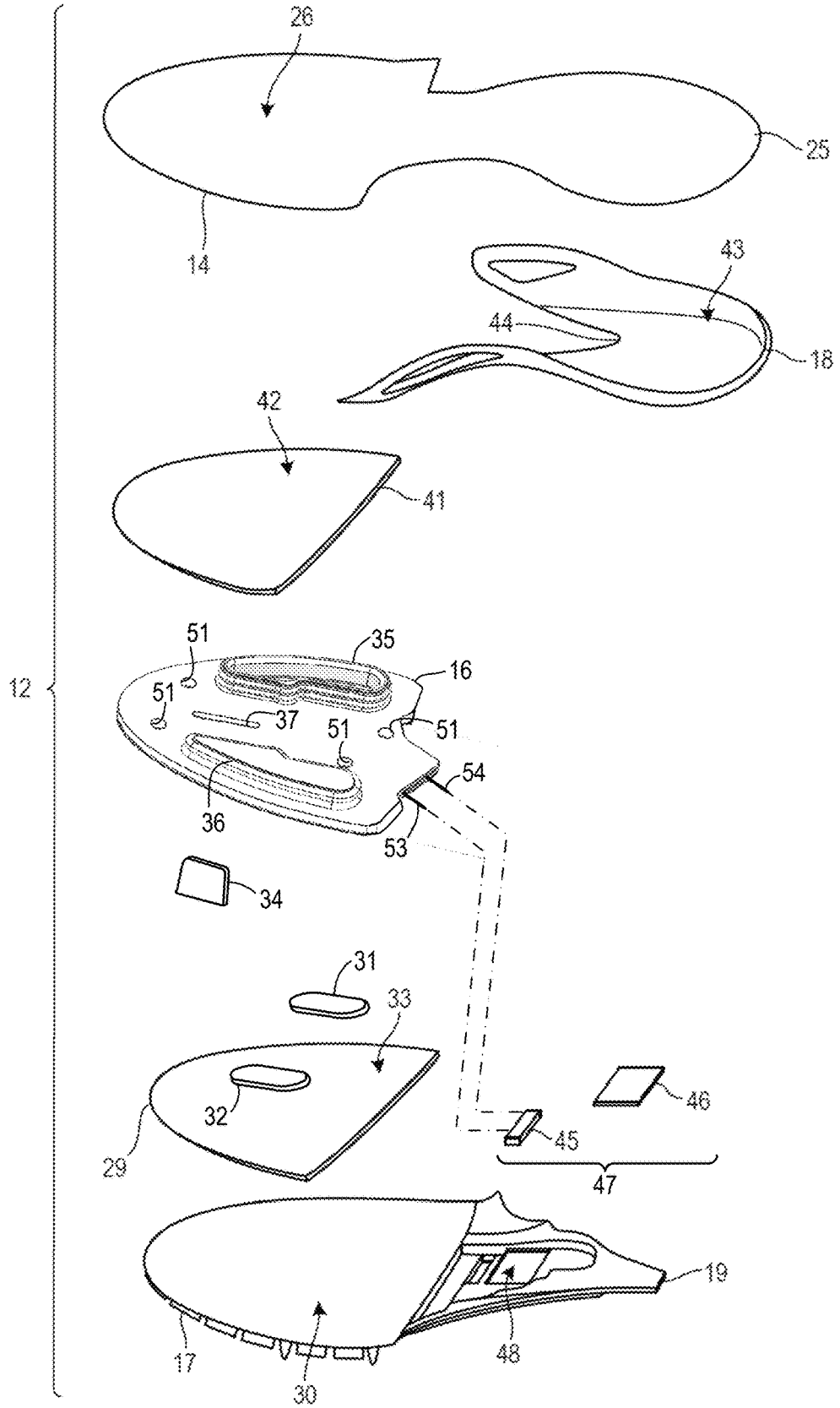
FIG. 3 is a partially exploded medial perspective view of the sole structure of the shoe of FIG. 1.

FIG. 3 is a partially exploded medial perspective view of sole structure 12. Bottom support plate 29 is located in the plantar region of shoe 10. In the embodiment of shoe 10, bottom support plate 29 is attached to a top surface 30 of forward outsole section 17. Bottom support plate 29, which may be formed from a relatively stiff polymer or polymer composite, helps to stiffen the forefoot region of forward outsole section 17 and provide a stable base for incline adjuster 16. A medial force-sensing resistor (FSR) 32 and a lateral FSR 31 are attached to a top surface 33 of bottom support plate 29. As explained below, FSRs 31 and 32 provide outputs that help determine pressures within chambers of incline adjuster 16.

Fulcrum element 34 is attached to top surface 33 of lower support plate 29. Fulcrum element 34 is positioned between FSRs 31 and 32 in a front portion of bottom support plate 29. Fulcrum element 34 may be formed from hard rubber or from one or more other materials that is generally incompressible under loads that result when a wearer of shoe 10 runs.

Incline adjuster 16 is attached to top surface 33 of lower support plate 29. A lateral chamber 35 of incline adjuster 16 is positioned over lateral FSR 31. A medial chamber 36 of incline adjuster 16 is positioned over medial FSR 32. Incline adjuster 16 includes an aperture 37 through which fulcrum element 34 extends. At least a portion of fulcrum element 34 is positioned between chambers 35 and 36. Through holes 51 in incline adjuster 16 may be used when fabricating incline adjuster 51, as described in more detail below. Through holes 51 may also be used to position and secure incline adjuster 16 relative to lower support plate 29. Corresponding protrusions, not shown in FIG. 3, may be formed on top surface 33 and extend into through holes 51 from the bottom side of incline adjuster 16.

A top support plate 41 is located in the plantar region of shoe 10 and is positioned over incline adjuster 16. In the embodiment of shoe 10, top support plate 41 is generally aligned with bottom support plate 29. Top support plate 41, which may also be formed from a relatively stiff polymer or polymer composite, provides a stable and relatively non-deformable region against which incline adjuster 16 may push, and which supports the forefoot region of footbed 14.

A forefoot region portion of the midsole 25 underside is attached to the top surface 42 of top support plate 41. Portions of the midsole 25 underside in the heel and side midfoot regions are attached to a top surface 43 of rear outsole section 18. End 19 of forward outsole section 17 is attached to rear outsole section 18 behind the rear-most location 44 of the front edge of section 18 so as to form joint 20. In some embodiments, end 19 may be a tab that slides into a slot formed in section 18 at or near location 14, and/or may be wedged between top surface 43 and the underside of midsole 25.

Also shown in FIG. 3 are a DC-to-high-voltage-DC converter 45 and a printed circuit board (PCB) 46 of a controller 47. Converter 45 converts a low voltage DC electrical signal into a high voltage (e.g., 5000V) DC signal that is applied to electrodes within incline adjuster 16. PCB 46 includes one or more processors, memory and other components and is configured to control incline adjuster 16 through converter 45. PCB 46 also receives inputs from FSRs 31 and 32 and receives electrical power from battery unit 13. PCB 46 and converter 45 may be attached to the top surface of forward outsole section 17 in a midfoot region 48, and may also rest within pockets 28 and 27, respectively, in the underside midsole 25.

Figure 4A:
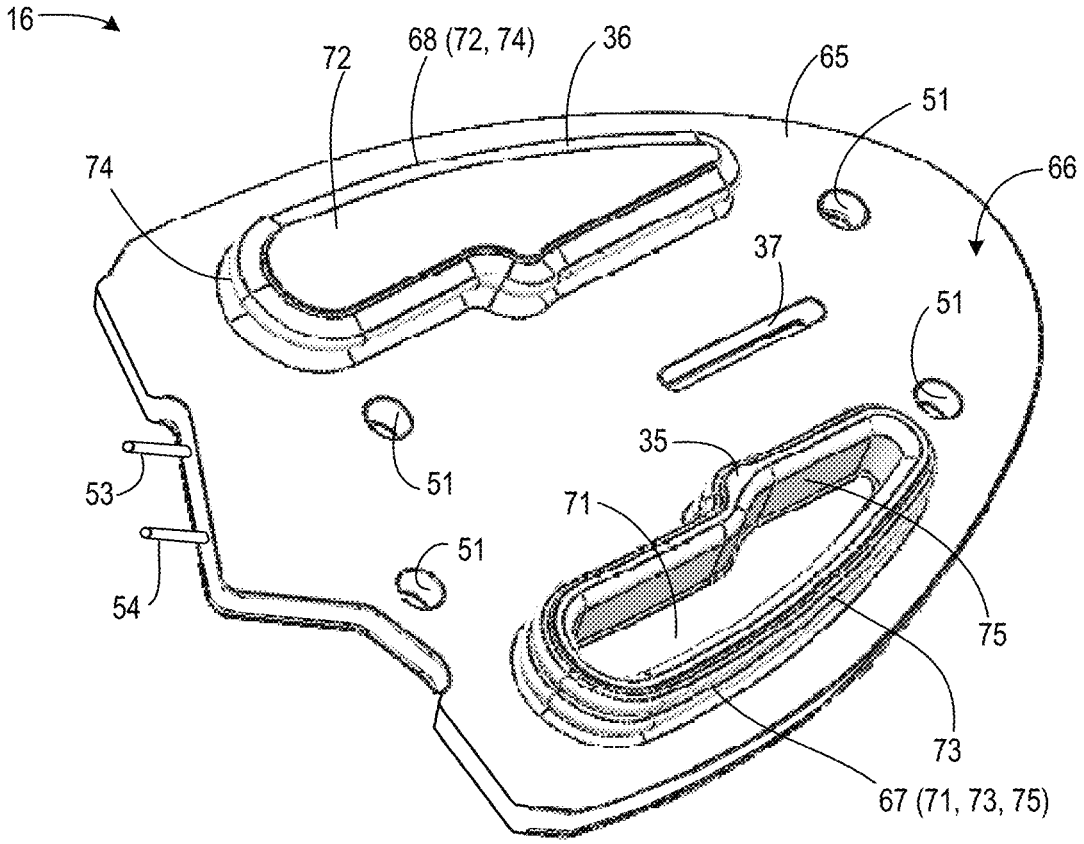
FIG. 4A is an enlarged rear lateral top perspective view of an incline adjuster of the shoe of FIG. 1.
Figure 4B:
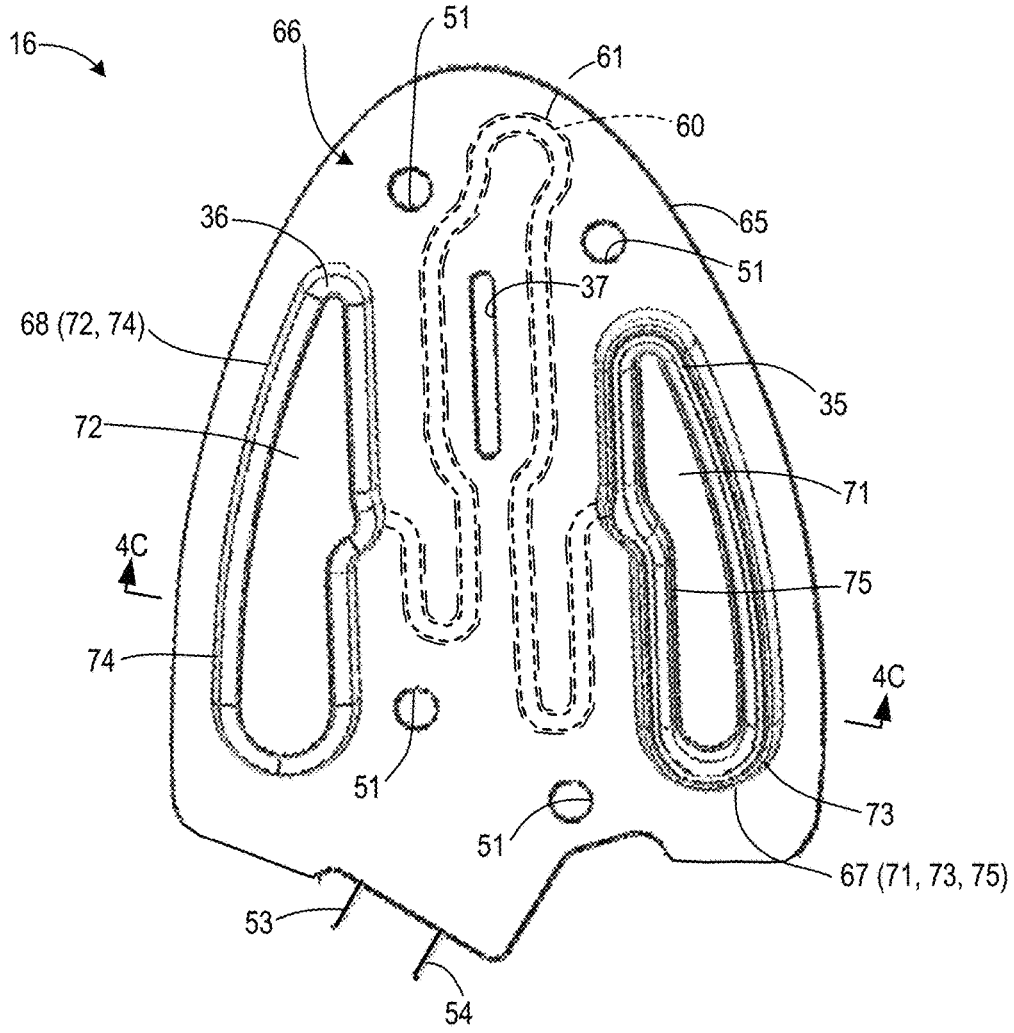
FIG. 4B is a top view of the incline adjuster of FIG. 4A.
Figure 4C:
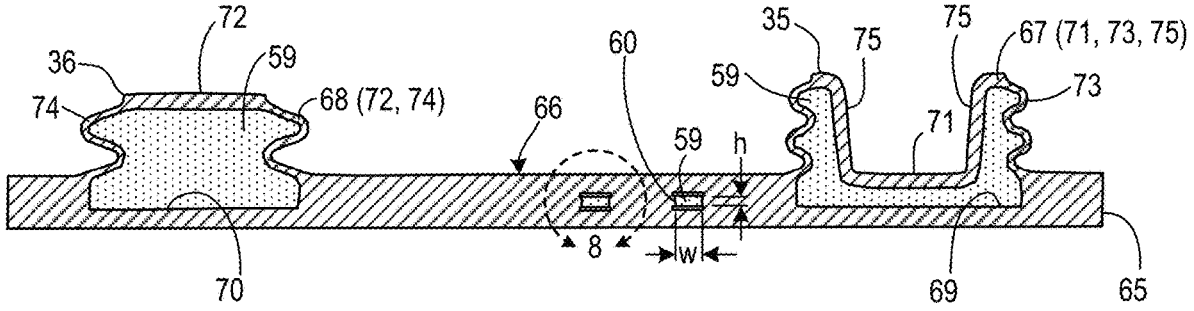
FIG. 4C is an area cross-sectional view taken from the plane indicated in FIG. 4B.

FIG. 4A is an enlarged rear lateral top perspective view of incline adjuster 16. FIG. 4B is an enlarged top view of incline adjuster 16. FIG. 4C is an area cross-sectional view taken from the plane indicated in FIG. 4B. Incline adjuster 16 includes a main body 65 (FIG. 4B). A portion of lateral chamber 35 is bounded by a flexible contoured wall 67 that extends upward from a lateral side of the top 66 of main body 65. Another portion of lateral chamber 35 bounded by a corresponding region 69 in main body 65 (FIG. 4C). A portion of medial chamber 36 is bounded by a flexible contoured wall 68 that extends upward from a medial side of top side 66, with another portion of medial chamber 36 bounded by a corresponding region 70 in main body 65.

Lateral chamber 35 is in fluid communication with medial chamber 36 through a fluid transfer channel 60 defined in a central portion of main body 65 and extending between chambers 35 and 36. Incline adjuster 16 is opaque in the embodiment of FIGS. 4A-4C, and the location of transfer channel 60 is therefore indicated in FIG. 4B with small broken lines. An ER fluid 59 fills chambers 35 and 36 and transfer channel 60. One example of an ER fluid that may be used in some embodiments is sold under the name "RheOil 4.0" by ERF Produktion Würzberg GmbH. The internal volume of lateral chamber 35 may vary as ER fluid 59 flows into or out of lateral chamber 35. The portion of chamber 35 formed by wall 67 is configured to expand when ER fluid 59 flows into lateral chamber 35, thereby displacing a central section 71 of wall 67 upward from main body 65. The internal volume of medial chamber 36 may similarly vary as ER fluid 59 flows into or out of medial chamber 36. The portion of chamber 36 formed by wall 68 is configured to expand when ER fluid 59 flows into medial chamber 36, thereby displacing a central section 72 of wall 68 upward from main body 65.

A pair of opposing electrodes is positioned within transfer channel 60 on bottom and top sides and extends along a flow regulating portion 61 of transfer channel 60, indicated in FIG. 4B with large broken lines. Leads 53 and 54 are in respective electrical contact with the bottom and top electrodes and are connected to converter 45. Transfer channel 60 has a serpentine shape so as to provide increased surface area for electrodes within channel 60 to create an electrical field in ER fluid 59 within channel 60. For example, and as seen in FIG. 4B, channel 60 includes three 180° curved sections joining other sections of channel 60 that cover the space between chambers 35 and 36. In some embodiments, transfer channel 60 may have a maximum height h between electrodes of 1 millimeter (mm), an average width (w) of 2 mm, and a length along the flow direction between chambers 35 and 36 of at least 200 mm. In some embodiments, transfer channel 60 may have a maximum height h between electrodes of 1 millimeter (mm), an average width (w) of 4 mm, and a length along the flow direction between chambers 35 and 36 of at least 200 mm.

In some embodiments, height of the transfer channel may practically be limited to a range of at least 0.250 mm to not more than 3.3 mm. An incline adjuster constructed of pliable material may be able to bend with the shoe during use. Bending across the transfer channel locally decreases the height at the point of bending. If sufficient allowance is not made, the corresponding increase in electric field strength may exceed the maximum dielectric strength of the ER fluid, causing the electric field to collapse. In the extreme, electrodes could become so close that they actually touch, with the same resultant electric field collapse.

The viscosity of ER fluid increases with the applied electric field strength. The effect is non-linear and the optimum field strength is in the range of 3 to 6 kilovolts per millimeter (kV/mm). The high-voltage dc-dc converter used to boost the 3 to 5 V of the battery may be limited by physical size and safety considerations to less than 2 W or a maximum output voltage of less than or equal to 10 kV. To keep the electric field strength within the desired range, the height of the transfer channel may therefore be limited in some embodiments to a maximum of about 3.3 mm (10 kV/3 kV/mm).

The width of a transfer channel may be practically limited to a range of at least 0.5 mm to not more than 4 mm. The maximum width of a channel may be limited by the physical space between the two chambers of the incline adjuster. If the channel is wide, the material within the middle layer may become thin and unsupported during construction, and walls of the channel may be easily dislodged. The equivalent series resistance of ER fluid will also decrease as the channel width increases, which increases the power consumption. For a shoe size range down to M7 (US) the practical width may be limited to less than 4 mm.

The opposing electrodes in flow regulating portion 61 of transfer channel 60 may be energized to increase the viscosity of ER fluid 59 in flow-regulating portion 61, thereby slowing or stopping flow of ER fluid 59 through channel 60. When flow through transfer channel 60 is enabled, downward force on section 72 forces ER fluid 59 out of medial chamber 36, through transfer channel 60, and into lateral chamber 35. As ER fluid 59 is transferred out of medial chamber 36 and into lateral chamber 35, section 72 moves downward toward main body 65 and section 71 moves upward away from main body 65. Conversely, downward force on section 71 (when flow through transfer channel 60 is enabled) forces ER fluid 59 out of lateral chamber 35, through transfer channel 60, and into medial chamber 36. As ER fluid 59 is transferred out of lateral chamber 35 and into medial chamber 36, section 71 moves downward toward main body 65 and section 72 moves upward away from main body 65. As discussed in more detail below in connection with FIGS. 10A-10D, change in the relative heights of section 71 and section 72 changes an inclination angle of top support plate 41 relative to bottom support plate 29.

The desired length of the transfer channel may be a function of the maximum pressure difference between chambers of the incline adjuster when in use. The longer the channel, the greater the pressure difference that can be withstood. Optimum channel length may be application dependent and construction dependent and therefore may vary among different embodiments. A detriment of a long channel is a greater restriction to fluid flow when the electric field is removed. In some embodiments, practical limits of channel length are in the range of 25 mm to 350 mm. In at least some embodiments, flow-regulating portion 61 may have an L/w ratio of at least 50, where L is the length of flow-regulating portion 61, and wherein w is the average width of flow-regulating portion 61. Exemplary minimum values for the L/w ratio of a transfer channel flow-regulating portion in other embodiments include 60, 70, 80, 90, 100, 110, 120, 130, 140, 150, 160, and 170. In some embodiments, the minimum area of each opposing electrode that contacts ER fluid in a flow-regulating transfer channel portion may be, for transfer channels with an average channel width of 4 mm, 800 square millimeters. As explained in more detail below, mounting features of electrodes may be encapsulated within the wall of the channel and thus may not contact the ER fluid. The total area of the electrode may therefore be greater than the exposed functional area.

As seen in FIG. 4C, wall 67 of lateral chamber 35 has an outer side section 73 that extends upward from top side 66 and joins an inner side section 75, with inner side section 75 joined to section 71. Sections 75 and 71 form a depression in the exterior shape of lateral chamber 35. This depression allows reduction in the total volume of ER fluid 59 needed within the system. In the embodiment of FIGS. 4A-4C, only lateral chamber 35 includes an external depression. In other embodiments, both lateral and medial chambers may include an external depression. In still other embodiments, only a medial chamber may include a depression. In yet other embodiments, neither a medial nor a lateral chamber includes a depression.

In some embodiments, incline adjuster chambers may have bellows shapes. For example, and as seen in FIG. 4C, outer side section 73 has folds that define a bellows shape of lateral chamber 35. Side section 74 of wall 68 also has folds that define a bellows shape of medial chamber 36. In the embodiment of FIGS. 4A-4C, the side of the lateral chamber has more folds than the side of the medial chamber. In some embodiments, chambers on both sides may the same number of folds, while in still other embodiments a medial chamber may have more folds than a lateral chamber. Bellows shapes of chambers facilitate increased flexure during expansion and contraction of chambers. This helps to minimize wear, as well as to decrease the total amount of ER fluid needed within the system. In some embodiments, one or both chambers may not have a bellows shape.

In some embodiments, incline adjuster 16 may be fabricated by separately forming bottom and top components. The bottom component may include regions 69 and 70 of chambers 35 and 36, respectively, a bottom portion of transfer channel 60, and a bottom electrode. The top component may include walls 67 and 68 of chambers 35 and 36, respectively, a top portion of transfer channel 60, and a top electrode. Once formed, a top side of the bottom component may be bonded to the bottom side of the top component. An internal volume comprising internal volumes of chamber 35, chamber 36, and transfer channel 60 may then be filled with ER fluid 59, and the internal volume sealed.

Figure 5A:
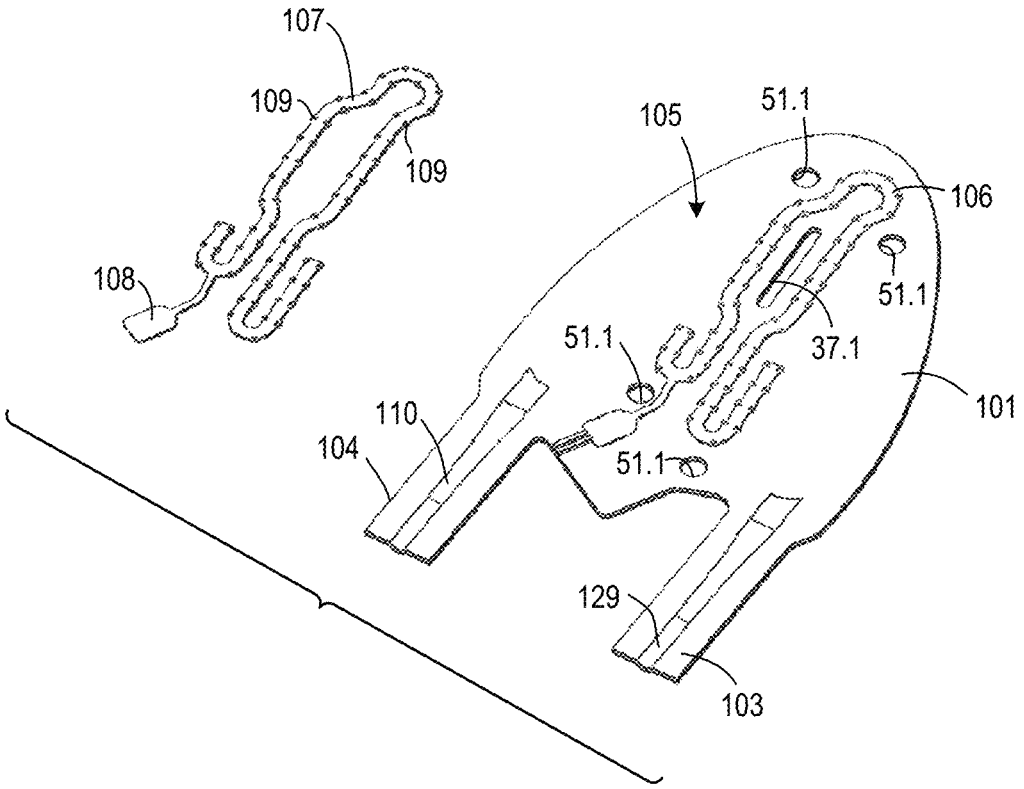
FIG. 5A shows a first layer of a first component of the incline adjuster of FIG. 4A, together with a metal first electrode.
Figure 5B:
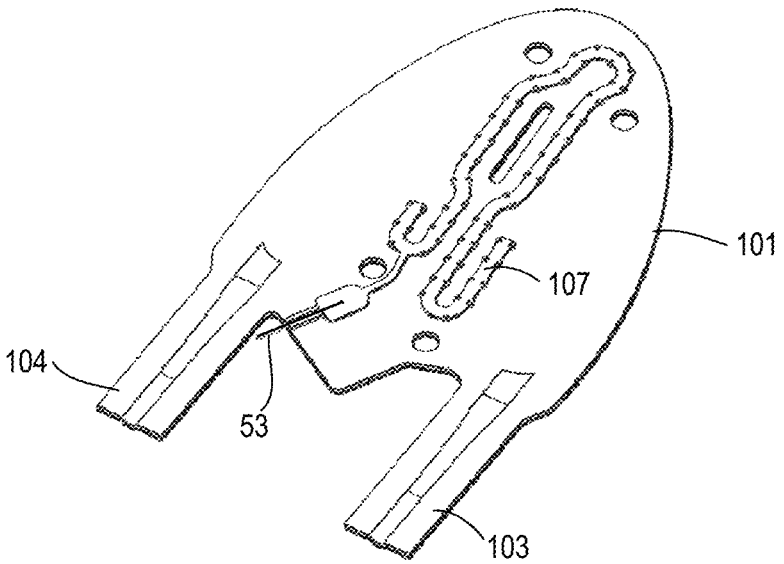
FIG. 5B shows the first layer of FIG. 5A after attachment of the first electrode of FIG. 5A.
Figure 5C:
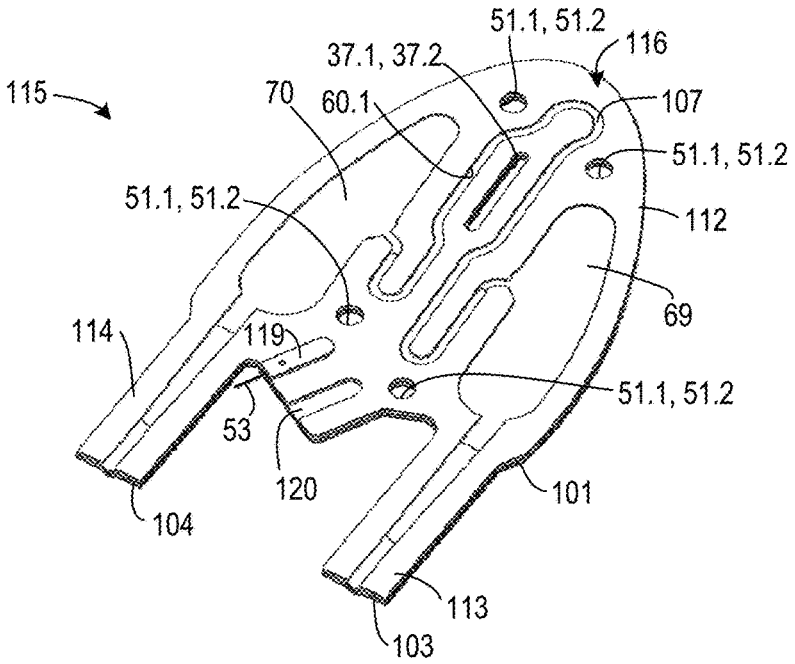
FIG. 5C shows the first component of the incline adjuster of FIG. 4A after molding of a second layer over the first layer and attached first electrode.

FIGS. 5A through 5C illustrate steps in forming the bottom component of incline adjuster 16. First, and as shown in FIG. 5A, a first layer 101 is injection molded. Layer 101 will form the bottom layer of the bottom component. The perimeter of layer 101 has a shape that, except for rear extensions 103 and 104, is the same as the shape of the perimeter of main body 65. Except for openings 51.1, which will form bottom-most portions of through holes 51, and opening 37.1, which will form the bottom-most portion of aperture 37, layer 101 is continuous. The top surface 105 of layer 101 includes a raised portion 106. Raised portion 106 has a shape that corresponds to, and that defines a seat for, a bottom electrode 107.

Bottom electrode 107, also shown in FIG. 5A, is a continuous metal sheet. In some embodiments, bottom electrode 107 may be formed from 0.05 mm thick, 1010 nickel plated, cooled rolled steel. Electrode 107 includes a pad 108 for attachment of lead 53. Edges of electrode 107 also include a series of slots 109 formed along both edges. Exemplary dimensions for slots 109 are 0.5 mm×1 mm. As described in more detail below, material may flow into slots 109 during molding of the bottom component to secure electrode 107 in position.

Extensions 103 and 104 will form portions of necks that will have sprues through which incline adjuster 16 may be filled with ER fluid 59. After filling, those sprues may be sealed and the necks removed. A channel 129 in extension 103 will form a portion of a lateral side sprue. A channel 110 in extension 104 will form a portion of a medial side sprue.

In FIG. 5B, electrode 107 is attached to raised portion 106. In some embodiments, a pressure-sensitive adhesive (PSA) may be applied to a bottom surface of electrode 107 and/or to a top surface of raised portion 106 to hold electrode 107 in place during a subsequent molding operation (described below). Lead 53 may be put in place and attached to pad 108 by soldering, by using conductive epoxy, or by other technique.

After attachment of electrode 107 and lead 53, a second layer 112 is overmolded onto layer 101. The resulting bottom component 115 of incline adjuster 16 is shown in FIG. 5C. Regions 69 and 70 of chambers 35 and 36, respectively, are defined in a top surface 116 of bottom component 115. A bottom portion 60.1 of transfer channel 60 is similarly formed in top surface 116. A portion of electrode 107 is exposed in bottom portion 60.1. Openings 51.2 and 37.2 in layer 112, which align with openings 51.1 and 37.1 in layer 101, will form additional portions of through holes 51 and aperture 37 in the completed incline adjuster 16. Layer 112 also includes extensions 113 and 114 that overlay extensions 103 and 104 of layer 101. A raised region 119, which extends from top surface 116 over lead 53, will fit into a depression in the bottom surface of the top component of incline adjuster 16. A depression 120 is formed in top surface 116 to accept a corresponding raised region, in the bottom surface of the top component, corresponding to lead 54.

In some embodiments, layer 101 may be injection molded from thermoplastic polyurethane (TPU). Layer 112 may be overmolded onto layer 101 (with attached electrode 107 and lead 53) by injection molding of additional TPU. Layer 112 may be formed from the same type of TPU used to form layer 101.

Figure 6A:
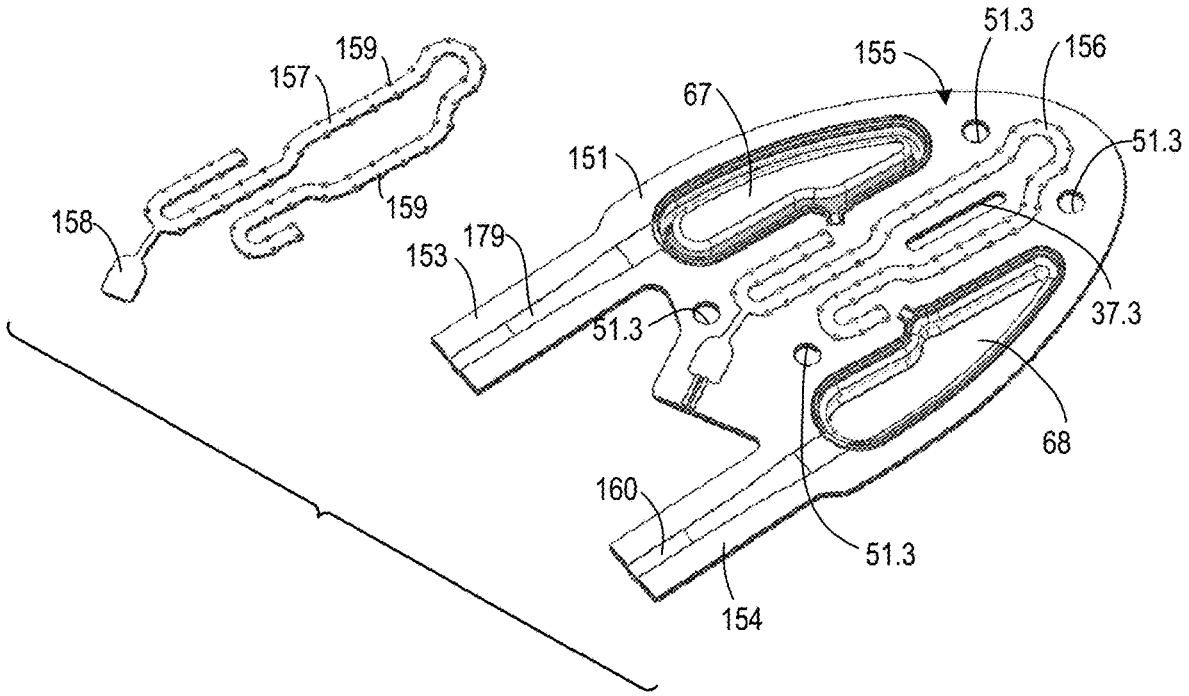
FIG. 6A shows a first layer of a second component of the incline adjuster of FIG. 4A, together with a metal second electrode.
Figure 6B:
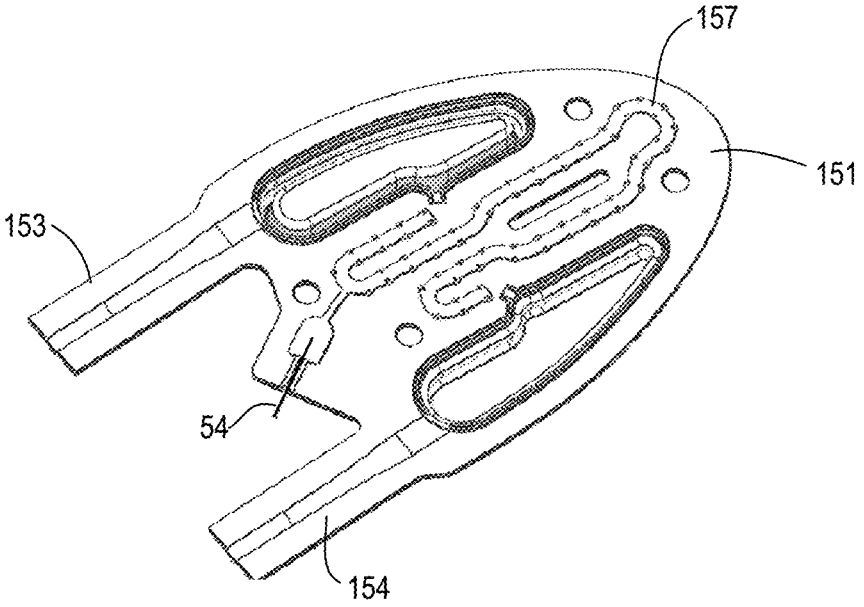
FIG. 6B shows the first layer of FIG. 6A after attachment of the second electrode of FIG. 6A.
Figure 6C:
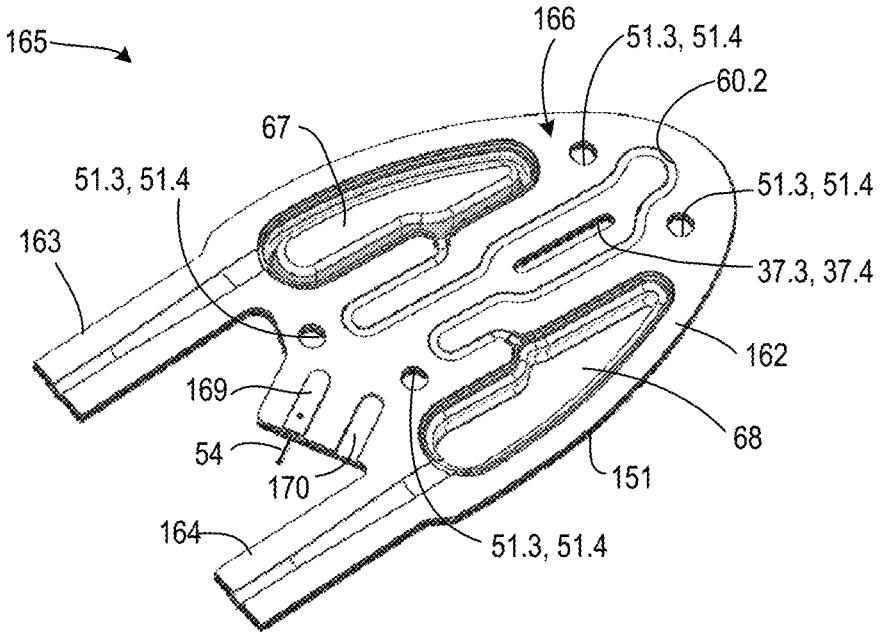
FIG. 6C shows the second component of the incline adjuster of FIG. 4A after molding of a second layer over the first layer and attached second electrode.

FIGS. 6A through 6C illustrate steps in forming the top component of incline adjuster 16. First, and as shown in FIG. 6A, a first layer 151 is injection molded. Layer 151 will form the top layer of the top component. The perimeter of layer 151 has a shape that, except for rear extensions 153 and 154, is the same as the shape of the perimeter of main body 65. Except for openings 51.3, which will form top-most portions of through holes 51, and opening 37.3, which will form the top-most portion of aperture 37, layer 151 is continuous. The top surface 155 of layer 151 includes a raised portion 156. Raised portion 156 has a shape that corresponds to, and that defines a seat for, a top electrode 157. As also seen in FIG. 6A, layer 151 includes countered walls 67 and 68, which are joined to the remaining portions of layer 151 around their edges. In FIG. 6A, layer 151 is inverted from the orientation of incline adjuster 16 in FIG. 4A. In particular, the bottom side of layer 151 is visible in FIG. 6A. Portions of the top side of layer 151 surrounding walls 67 and 68, which portions are not visible in FIG. 6A, will form top 66 of main body 65 in the completed incline adjuster 16. Extensions 153 and 154 will form portions of the necks that will have the sprues through which incline adjuster 16 may be filled with ER fluid 59. A channel 179 in extension 153 will form a portion of a lateral side sprue. A channel 160 in extension 154 will form a portion of a medial side sprue.

Top electrode 157 is also shown in FIG. 6A. Electrode 157 is also a continuous metal sheet and may be formed from the same material used to form electrode 107. Electrode 157 includes a pad 158 for attachment of lead 54. Edges of electrode 157 also include a series of slots 159 formed along both edges. Exemplary dimensions for slots 159 may be the same as those of slots 109 in electrode 107.

Electrode 157 is attached to raised portion 156 in FIG. 6B. In some embodiments, a PSA may be applied to a top surface of electrode 157 and/or to a bottom surface of raised portion 156 to hold electrode 157 in place during a subsequent molding operation (described below). Lead 54 may be put in place and attached to pad 158 by soldering, by using conductive epoxy, or by other technique.

After attachment of electrode 157 and lead 54, a second layer 162 is overmolded onto layer 151. The resulting top component 165 of incline adjuster 16 is shown in FIG. 6C. Openings to interior regions of chambers 35 and 36 within walls 67 and 68, respectively, are defined in a bottom surface 166 of top component 165. A top portion 60.2 of transfer channel 60 is similarly formed in bottom surface 166. A portion of electrode 157 is exposed in top portion 60.2. Openings 51.4 and 37.4 in layer 162, which align with openings 51.3 and 37.3 in layer 151, will form additional portions of through holes 51 and aperture 37 in the completed incline adjuster 16. Layer 162 also includes extensions 163 and 164 that overlay extensions 153 and 154 of layer 151. A raised region 169, which extends from bottom surface 166 over lead 54, will fit into depression 120 in top surface 116 of bottom component 115. A depression 170 is formed in bottom surface 166 to accept raised region 119 in top surface 116 of bottom component 115.

In some embodiments, layer 151 may be injection molded from TPU. Layer 162 may be overmolded onto layer 151 (with attached electrode 157 and lead 54) by injection molding of additional TPU. Layers 151 and 162 may be formed from the same type of TPU used to form layers 101 and 112, or may be formed from a different type of TPU.

Figure 7A:
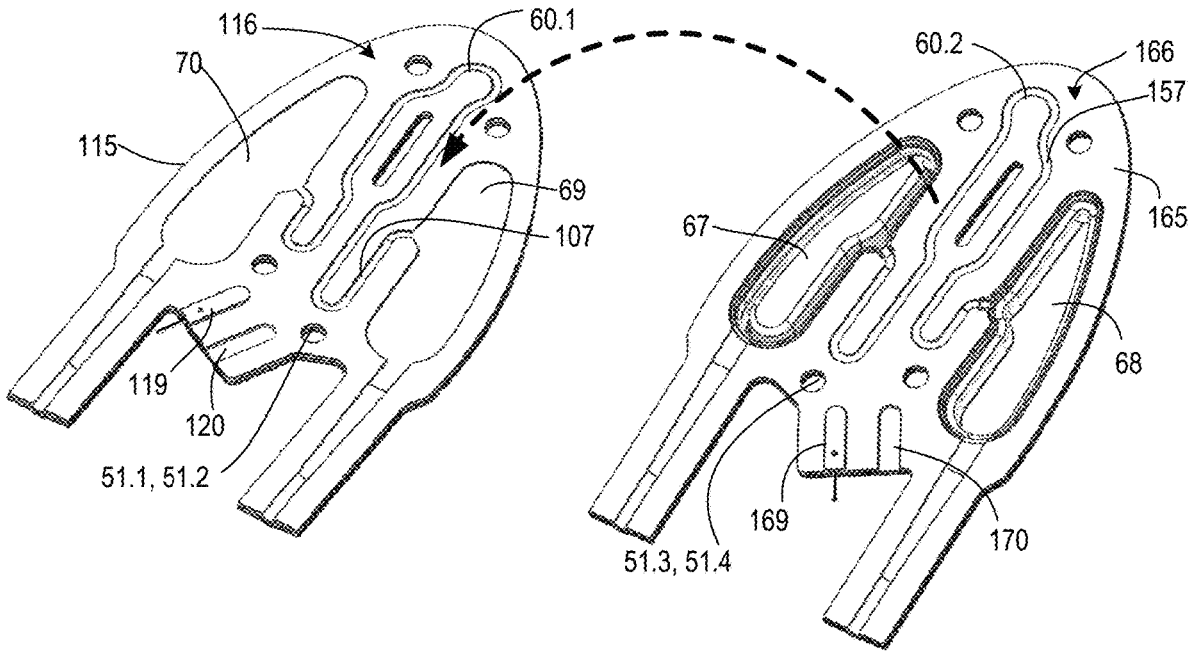
FIGS. 7A and 7B show assembly of the incline adjuster of FIG. 4A from the first component of FIG. 5C and the second component of FIG. 6C.

FIG. 7A shows assembly of incline adjuster 16 after fabrication of bottom component 115 and top component 116. Bottom surface 166 of top component 165 is placed into contact with top surface 116 of bottom component 115. Components 115 and 165 are assembled so that bottom portion 60.1 and top portion 60.2 are aligned to form transfer channel 60, region 69 is aligned with the opening to the interior of the cavity bounded by wall 67 to form lateral chamber 35, region 70 is aligned with the opening to the interior of the cavity bounded by wall 68 to form medial chamber 36, raised region 119 is located within depression 170, and raised region 169 is located in depression 120.

Figure 7B:
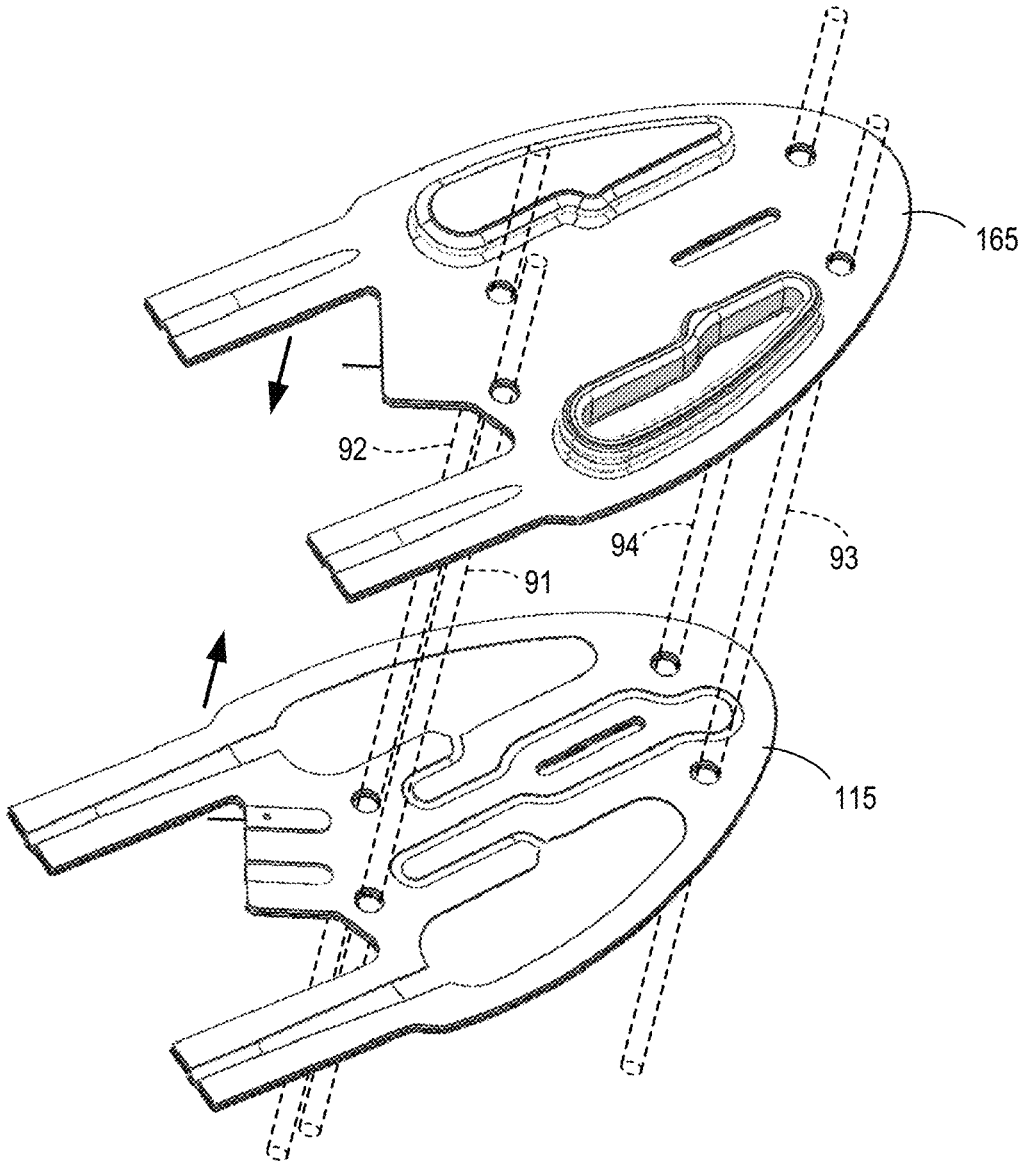

FIG. 7B shows alignment of components 115 and 165 during assembly according to some embodiments. A dowel 91 is inserted through the rear lateral hole in component 115 formed by a hole 50.1 in layer 101 and a hole 50.2 in layer 112. Dowel 91 is then inserted through the rear lateral hole in component 165 formed by a hole 50.3 in layer 151 and a hole 50.4 in layer 162. In a similar manner, dowel 92 is inserted through the rear medial hole in component 115 and the rear medial hole in component 165, dowel 93 is inserted through the front lateral hole in component 115 and the front lateral hole in component 165, and dowel 94 is inserted through the front medial hole in component 115 and the front medial hole in component 165. Components 115 and 165 may then be slid along dowels 91-94 until surfaces 116 and 166 are in contact. Surfaces 116 and 166 may then be bonded together using RF welding or chemical adhesive.

Figure 7C:
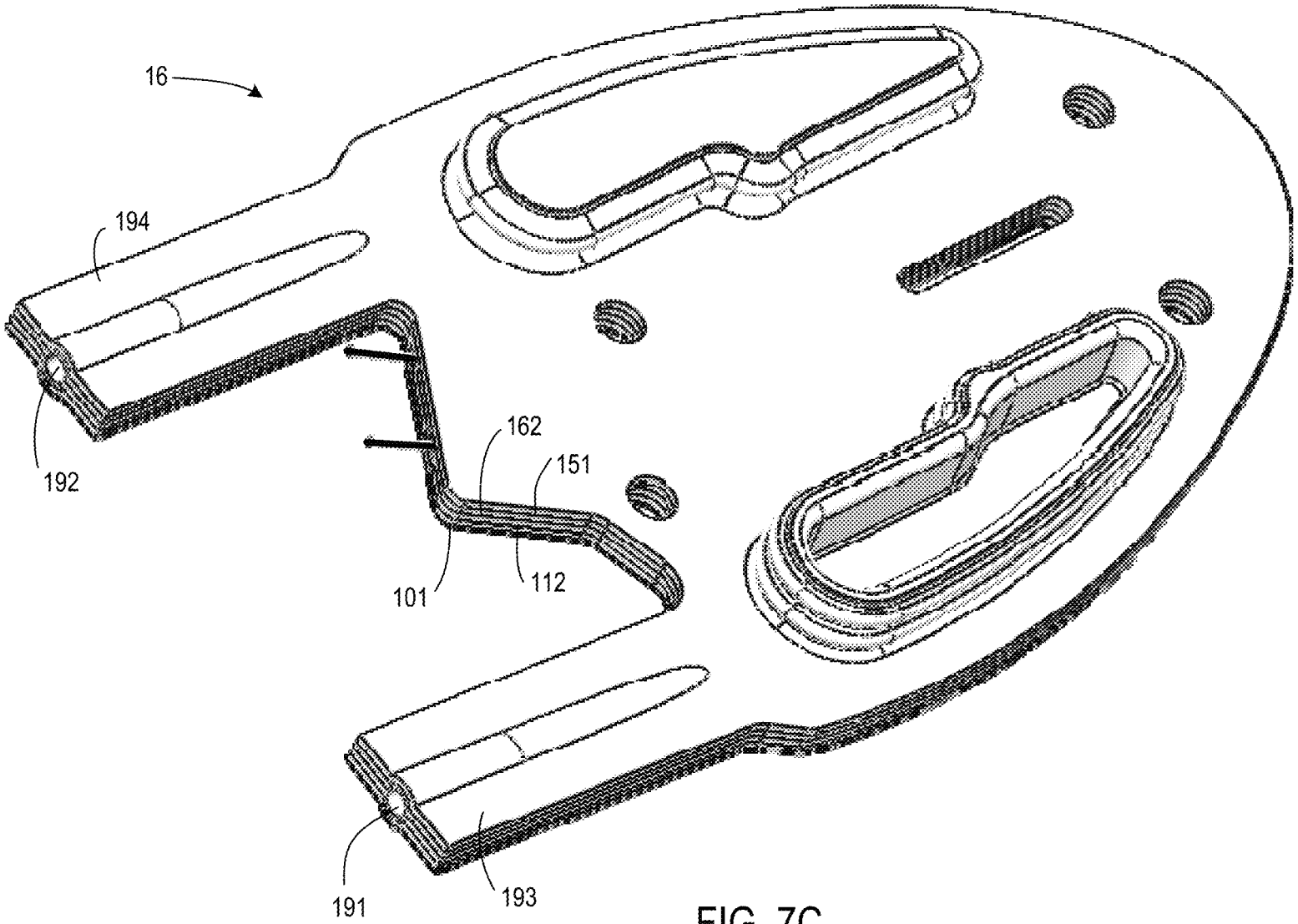
FIG. 7C is an enlarged rear lateral top perspective view of an incline adjuster after assembly and prior to filling with ER fluid.

FIG. 7C is an enlarged perspective view of incline adjuster 16 after bonding of components 115 and 165, but prior to filling incline adjuster 16 with ER fluid 59. For purposes of illustration, layers 101, 112, 151, and 152 are indicated in FIG. 7C. However, in at least some embodiments (e.g., when the same material of the same color is used for all layers), individual layers may not be distinguishable in incline adjuster 16.

Neck 193 is formed by rear extensions 103 and 113 of layers 101 and 112, respectively, as well as by rear extensions 153 and 163 of layers 151 and 162, respectively. A sprue 191, formed by channels 129 and 179, provides a passage into lateral chamber 35. Neck 194 is formed by rear extensions 104 and 114 of layers 101 and 112, respectively, as well as by rear extensions 154 and 164 of layers 151 and 162, respectively. A sprue 192, formed by channels 110 and 160, provides a passage into medial chamber 36. ER fluid 59 may then be injected through one of sprues 191 or 192 until it flows out of the other of sprues 191 or 192. In some embodiments, a degassing procedure such as is described in U.S. Patent Application Publication No. 2017/0150785 (incorporated by reference herein) may be used. In some embodiments, a degassing procedure such as is described in U.S. Provisional Patent Application No. 62/552,555, filed on August 31 2017, titled "Degassing Electrorheological Fluid" (incorporated by reference herein) may be employed. After filling and degassing, sprues 191 and 192 may be sealed (e.g., by RF welding across sprues 191 and 192), thus sealing an internal volume formed by the internal volumes of chambers 35 and 36 and transfer channel 60. Portions of necks 193 and 194 rearward of the seals may then be cut away.

Figure 8:
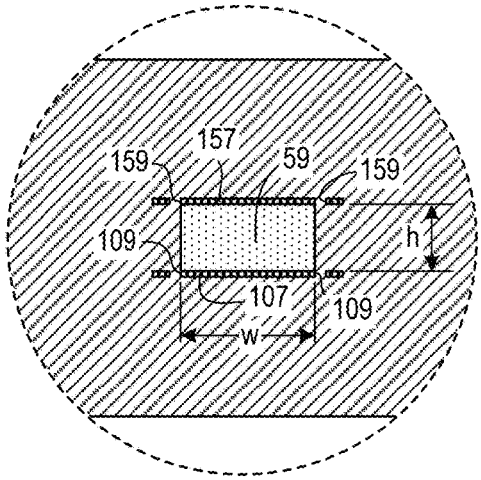
FIG. 8 is an enlarged area cross-sectional view of a portion of a transfer channel of the incline adjuster of FIG. 4A.

FIG. 8 is an enlarged portion of the area cross-sectional view of FIG. 4B and shows additional details of a transfer channel with embedded electrodes 107 and 157. Bottom electrode 107 spans the bottom of transfer channel 60 in flow regulating portion 61. Top electrode 157 spans the top of transfer channel 60 in flow regulating portion 61. Side edges of electrodes 107 and 157 extend beyond the sides of transfer channel 60 and into the material of main body 65. As seen in FIG. 8, the material of main body 65 has flowed into, and solidified within, slots 109 and 159 and anchors electrodes 107 and 157 in place. As indicated above, in some embodiments transfer channel 60 may have a maximum height h between electrodes of 1 millimeter (mm), an average width (w) of 2 mm.

Figure 9:
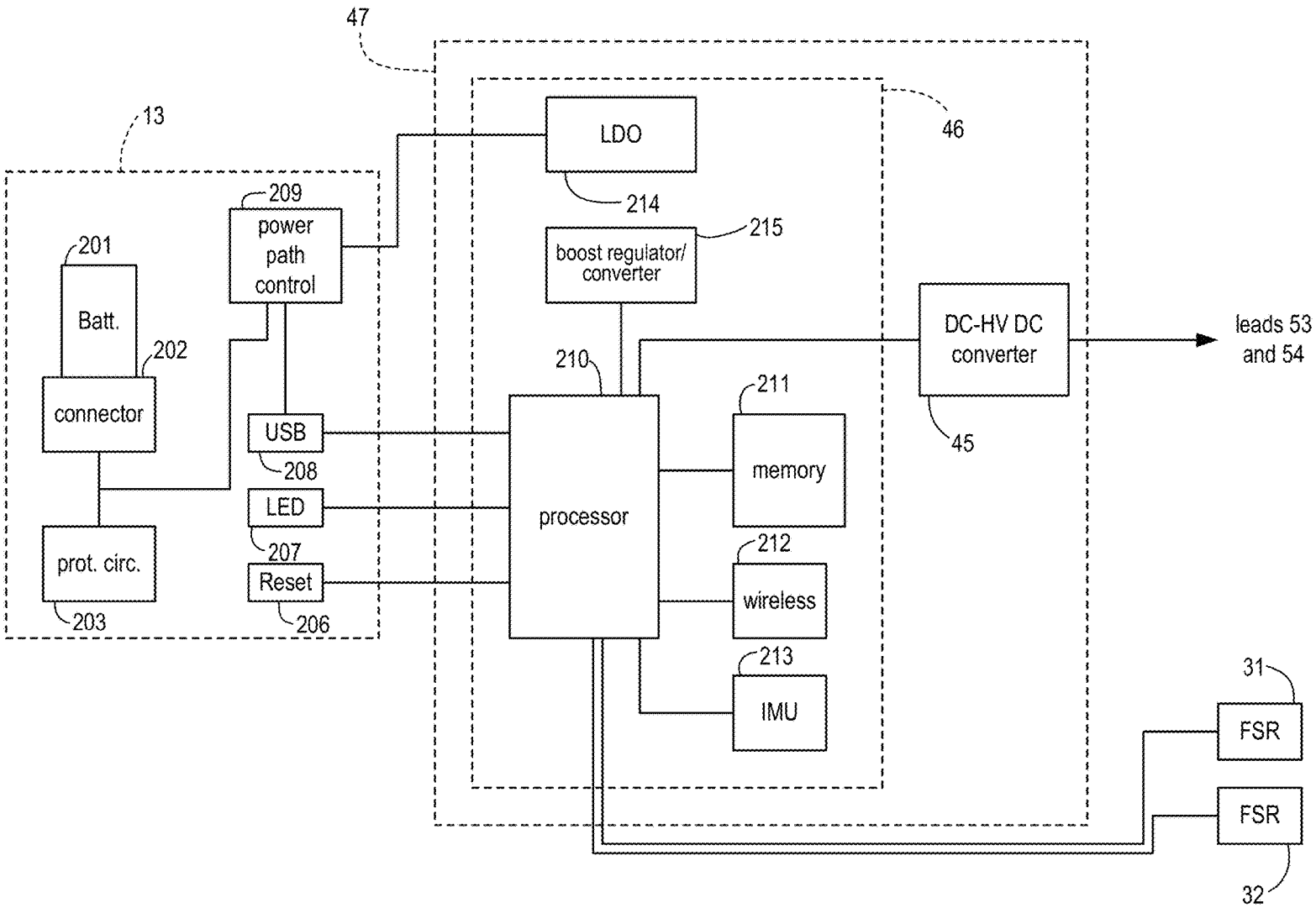
FIG. 9 is a block diagram showing electrical system components in the shoe of FIG. 1.

FIG. 9 is a block diagram showing electrical system components of shoe 10. Individual lines to or from blocks in FIG. 9 represent signal (e.g., data and/or power) flow paths and are not necessarily intended to represent individual conductors. Battery pack 13 includes a rechargeable lithium ion battery 201, a battery connector 202, and a lithium ion battery protection IC (integrated circuit) 203. Protection IC 203 detects abnormal charging and discharging conditions, controls charging of battery 201, and performs other conventional battery protection circuit operations. Battery pack 13 also includes a USB (universal serial bus) port 208 for communication with controller 47 and for charging battery 201. A power path control unit 209 controls whether power is supplied to controller 47 from USB port 208 or from battery 201. An ON/OFF (O/O) button 206 activates or deactivates controller 47 and battery pack 13. An LED (light emitting diode) 207 indicates whether the electrical system is ON or OFF. The above-described individual elements of battery pack 13 may be conventional and commercially available components that are combined and used in the novel and inventive ways described herein.

Controller 47 includes the components housed on PCB 46, as well as converter 45. In other embodiments, the components of PCB 46 and converter 45 may be included on a single PCB, or may be packaged in some other manner. Controller 47 includes a processor 210, a memory 211, an inertial measurement unit (IMU) 213, and a low energy wireless communication module 212 (e.g., a BLUETOOTH communication module).

Memory 211 stores instructions that may be executed by processor 210 and may store other data. Processor 210 executes instructions stored by memory 211 and/or stored in processor 210, which execution results in controller 47 performing operations such as are described herein. As used herein, instructions may include hard-coded instructions and/or programmable instructions.

IMU 213 may include a gyroscope and an accelerometer and/or a magnetometer. Data output by IMU 213 may be used by processor 210 to detect changes in orientation and motion of shoe 10, and thus of a foot wearing shoe 10. As explained in more detail below, processor 10 may use such information to determine when an incline of a portion of shoe 10 should change. Wireless communication module 212 may include an ASIC (application specific integrated circuit) and be used to communicate programming and other instructions to processor 210, as well as to download data that may be stored by memory 211 or processor 210.

Controller 47 includes a low-dropout voltage regulator (LDO) 214 and a boost regulator/converter 215. LDO 214 receives power from battery pack 13 and outputs a constant voltage to processor 210, memory 211, wireless communication module 212, and IMU 213. Boost regulator/converter 215 boosts a voltage from battery pack 13 to a level (e.g., 5 volts) that provides an acceptable input voltage to converter 45. Converter 45 then increases that voltage to a much higher level (e.g., 5000 volts) and supplies that high voltage across electrodes 107 and 157 of incline adjuster 16. Boost regulator/converter 215 and converter 45 are enabled and disabled by signals from processor 210. Controller 47 further receives signals from lateral FSR 31 and from medial FSR 32. Based on those signals from FSRs 31 and 32, processor 210 determines whether forces from a wearer foot on lateral fluid chamber 35 and on medial fluid chamber 36 are creating a pressure within chamber 35 that is higher than a pressure within chamber 36, or vice versa.

The above-described individual elements of controller 47 may be conventional and commercially available components that are combined and used in the novel and inventive ways described herein. Moreover, controller 47 is physically configured, by instructions stored in memory 211 and/or processor 210, to perform the herein described novel and inventive operations in connection with controlling transfer of fluid between chambers 35 and 36 so as to adjust the incline of the forefoot portion of the shoe 10 footbed 14.

FIGS. 10A through 10D are partially schematic area cross-sectional diagrams showing operation of incline adjuster 16, according to some embodiments, when going from a minimum incline condition to a maximum incline condition. In the minimum incline condition, an incline angle $\alpha$ of the top plate relative to the bottom plate has a value of $\alpha_{min}$ representing a minimum amount of incline sole structure 12 is configured to provide in the forefoot region. In some embodiments, $\alpha_{min}=0°$. In the maximum incline condition, the incline angle $\alpha$ has a value of $\alpha_{max}$ representing a maximum amount of incline sole structure 12 is configured to provide. In some embodiments, $\alpha_{max}$ is at least 5°. In some embodiments, $\alpha_{max}=10°$. In some embodiments, $\alpha_{max}$ may be greater than 10°.

In FIGS. 10A-10D, bottom plate 29, incline adjuster 16, top plate 41, FSR 31, FSR 32, and fulcrum element 34 are represented, but other elements are omitted for simplicity. Top plate 41 and other elements of sole structure 12 are configured so that downward force on plate 41 in a direction toward incline adjuster 16 is transferred to medial chamber 36 and lateral chamber 35, and/or to fulcrum 34 and/or other elements, but is not transferred to the central portion of main body 65 between chamber 35 and 36, and so that such downward force on plate 41 does not compress a region of that central portion containing electrodes 107 and 157. FIG. 10E is a top view of incline adjuster 16 (in a minimum incline condition) and bottom plate 29 showing the approximate locations of the sectioning lines corresponding to the views of FIGS. 10A-10D. Top plate 41 is omitted from FIG. 10E, but the peripheral edge of top plate 41 would generally coincide with that of bottom plate 29 if top plate 41 were included In FIG. 10E. Although fulcrum element 34 would not appear in an area cross-section according to the section lines of FIG. 10E, the general position of fulcrum element 34 relative to the medial and lateral sides of other elements in FIGS. 10A-10D is indicated with broken lines.

Also indicated in FIGS. 10A through 10D are a medial side stop 83 and a lateral side stop 82. Medial side stop 83 supports the medial side of top plate 41 when incline adjuster 16 and top plate 41 are in the maximum incline condition. Lateral side stop 82 supports the lateral side of top plate 41 when incline adjuster 16 and top plate 41 are in the minimum incline condition. Lateral side stop 82 prevents top plate 41 from tilting toward the lateral side. Because runners proceed around a track in a counterclockwise direction during a race, a wearer of shoe 10 will be turning to his or her left when running on curved portions of a track. In such a usage scenario, there would be no need to incline the footbed of a right shoe sole structure toward the lateral side. In other embodiments, however, a sole structure may be tiltable to either medial or lateral side.

In some embodiments, a left shoe from a pair that includes shoe 10 may be configured in a slightly different manner from what is shown in FIGS. 10A-10D. For example, a medial side stop may be at a height similar to that of lateral side stop 82 of shoe 10, and a lateral side stop may be at a height similar to that of medial side stop 83 of shoe 10. In such embodiments, the top plate of the left shoe moves between a minimum incline condition and maximum incline condition in which the top plate is inclined to the lateral side.

The locations of medial side stop 83 and of lateral side stop 82 are represented schematically in FIGS. 10A-10D, and are not shown in previous drawing figures. In some embodiments, lateral side stop 82 may be formed as a rim on the lateral side or edge of bottom plate 29. Similarly, medial side stop 83 may be formed as a rim on the medial side or edge of bottom plate 29.

Figure 10A:
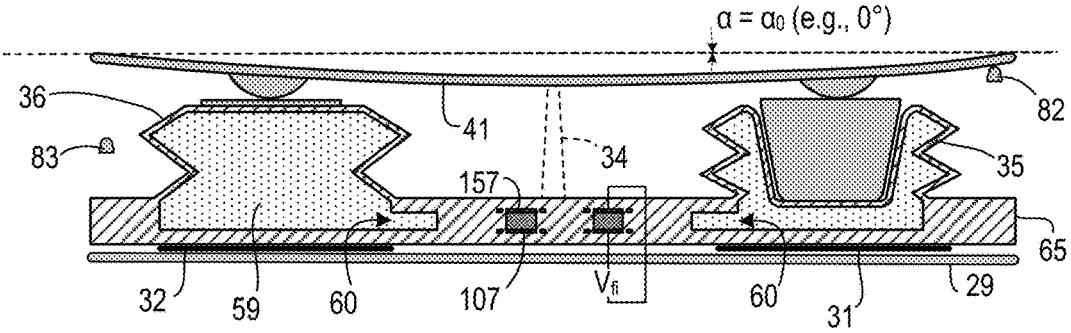
FIGS. 10A through 10D are partially schematic area cross-sectional diagrams showing operation of the incline adjuster of the shoe of FIG. 1 when going from a minimum incline condition to a maximum incline condition.

FIG. 10A shows incline adjuster 16 when top plate 41 is in a minimum incline condition. Shoe 10 may be configured to place top plate 41 into the minimum incline condition when a wearer of shoe 10 is standing or is in starting blocks about to begin a race, or when the wearer is running a straight portion of a track. In FIG. 10A, controller 47 is maintaining the voltage across electrodes 107 and 157 at one or more flow-inhibiting voltage levels ($V=V_{fi}$). The voltage across electrodes 107 and 157 is high enough to generate an electrical field having a strength sufficient to increase the viscosity of ER fluid 59 in transfer channel 60 to a viscosity level that prevents flow out of or into chambers 35 and 36. In some embodiments, a flow-inhibiting voltage level $V_{fi}$ is a voltage sufficient to create a field strength between electrodes 107 and 157 of between 3 kV/mm and 6 kV/mm. In FIGS. 10A through 10D, light stippling is used to indicate ER fluid 59 having a viscosity that is at a normal viscosity level, i.e., unaffected by an electrical field. Dense stippling is used to indicate ER fluid 59 in which the viscosity has been raised to a level that blocks flow through channel 60. Because ER fluid 59 cannot flow through channel 60 under the conditions shown in FIG. 10A, the incline angle $\alpha$ of top plate 41 does not change if the wearer of shoe 10 shifts weight between medial and lateral sides of shoe 10.

Figure 10B:
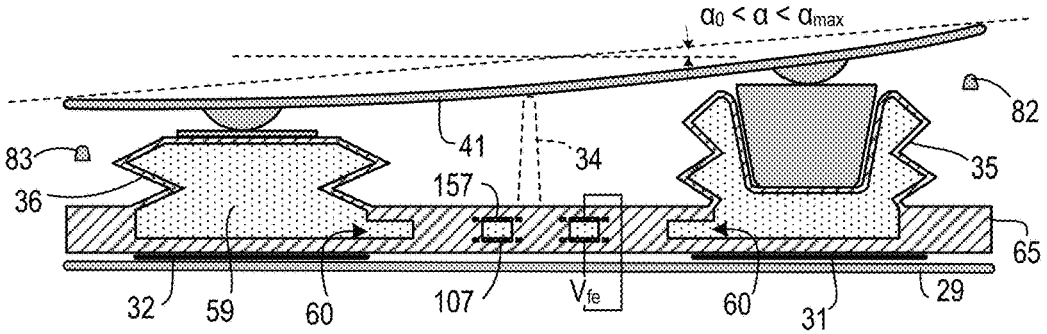

FIG. 10B shows incline adjuster 16 soon after controller 47 has determined that top plate 41 should be placed into the maximum incline condition, i.e., inclined to $\alpha=\alpha_{max}$. In some embodiments, and as explained below, controller 47 makes such a determination based on a number of steps taken by the shoe 10 wearer. Upon determining that top plate 41 should be inclined to $\alpha_{max}$, controller 47 determines if the foot wearing shoe 10 is in a portion of the wearer gait cycle in which shoe 10 is in contact with the ground. Controller 47 also determines if a difference $\Delta P_{M-L}$ between the pressure $P_M$ of ER fluid 59 in medial side chamber 36 and the pressure $P_L$ of ER fluid 59 in lateral side chamber 35 is positive, i.e., if $P_M-P_L$ is greater than zero. If shoe 10 is in contact with the ground and $\Delta P_{M-L}$ is positive, controller 47 reduces the voltage across electrodes 107 and 157 to a flow-enabling voltage level $V_{fe}$. In particular, the voltage across electrodes 107 and 157 is reduced to a level that is low enough to reduce the strength of the electrical field in transfer channel 60 so that the viscosity of ER fluid 59 in transfer channel 60 is at a normal viscosity level.

Upon reducing the voltage across electrodes 107 and 157 to a $V_{fe}$ level, the viscosity of ER fluid 59 in channel 60 drops. ER fluid 59 then begins flowing out of chamber 36 and into chamber 35. This allows the medial side of top plate 41 to begin moving toward bottom plate 29, and the lateral side of top plate 41 to begin moving away from bottom plate 29. As a result, the incline angle $\alpha$ begins to increase from $\alpha_{min}$.

In some embodiments, controller 47 determines if shoe 10 is in a step portion of the gait cycle and in contact with the ground based on data from IMU 213. In particular, IMU 213 may include a three-axis accelerometer and a three-axis gyroscope. Using data from the accelerometer and gyroscope, and based on known biomechanics of a runner foot, e.g., rotations and accelerations in various directions during different portions of a gait cycle, controller 47 can determine whether the right foot of the shoe 10 wearer is stepping on the ground. Controller 47 may determine if $\Delta P_{M-L}$ is positive based on the signals from FSR 31 and FSR 32. Each of those signals corresponds to magnitude of a force from a wearer foot pressing down on the FSR. Based on the magnitudes of those forces and on the known dimensions of chambers 35 and 36, controller 47 can correlate the values of signals from FSR 31 and FSR 32 to a magnitude and a sign of $\Delta P_{M-L}$.

Figure 10C:
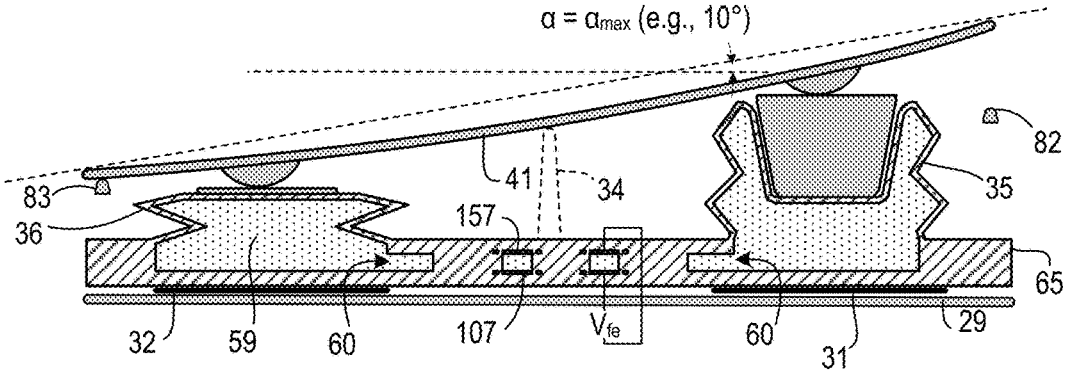
Figure 10D:
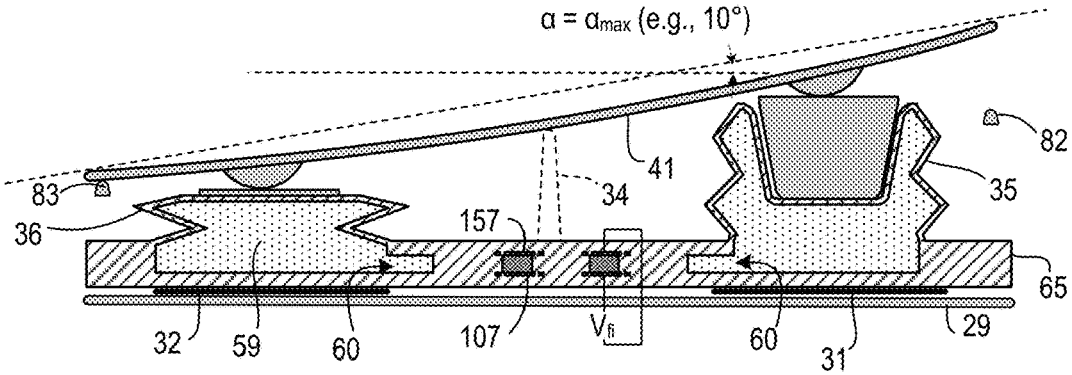
Figure 10E:
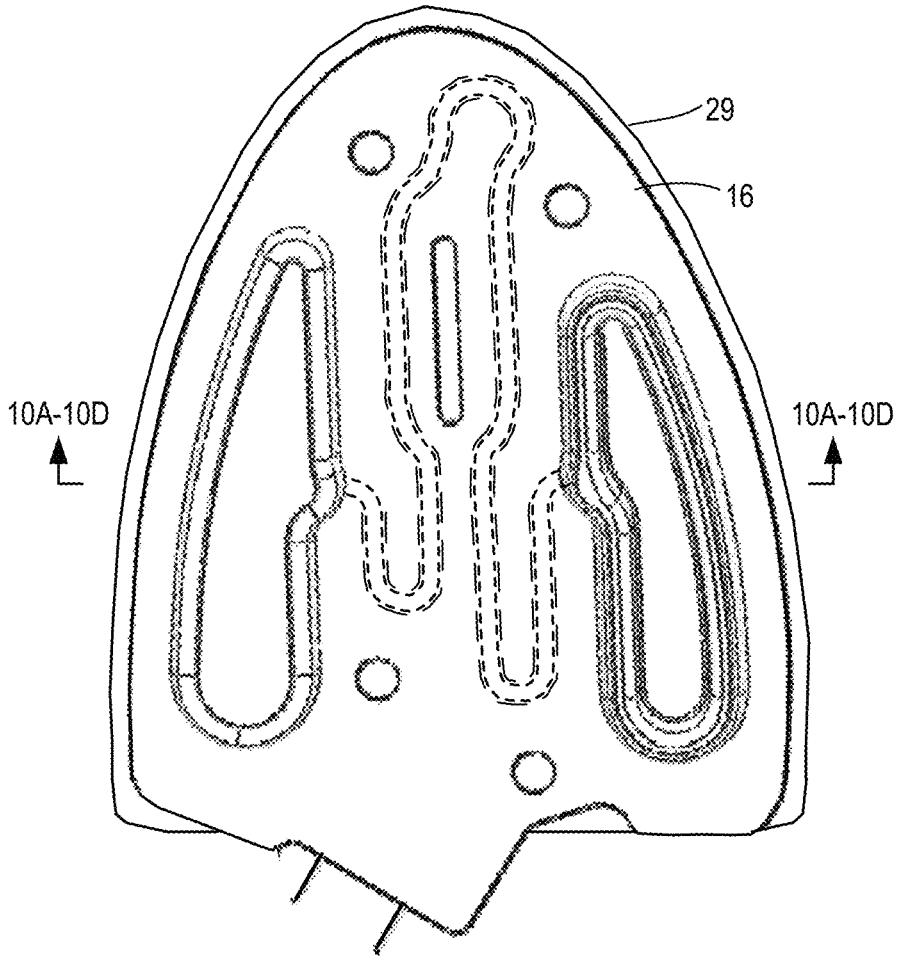
FIG. 10E is a top view of the incline adjuster and a bottom plate of the shoe of FIG. 1, and showing the approximate locations of sectioning lines corresponding to the views of FIGS. 10A-10D.

FIG. 10C shows incline adjuster 16 very soon after the time associated with FIG. 10B. In FIG. 10C, top plate 41 has reach the maximum incline condition. In particular, the incline angle $\alpha$ of top plate 41 has reached $\alpha_{max}$. Medial stop 83 prevents incline angle $\alpha$ from exceeding $\alpha_{max}$. FIG. 10D shows incline adjuster 16 very soon after the time associated with FIG. 10C. In FIG. 10D, controller 47 has raised the voltage across electrodes 107 and 157 to a flow-inhibiting voltage level $V_{fi}$. This prevents further flow through transfer channel 60 and holds top plate 41 in the maximum incline condition. During a normal gait cycle, downward force of a right foot on a shoe is initially higher on the lateral side as the forefoot rolls to the medial side. If flow through channel 60 were not prevented, the initial downward force on the lateral side of the wearer right foot would decrease incline angle $\alpha$.

Figure 11A:
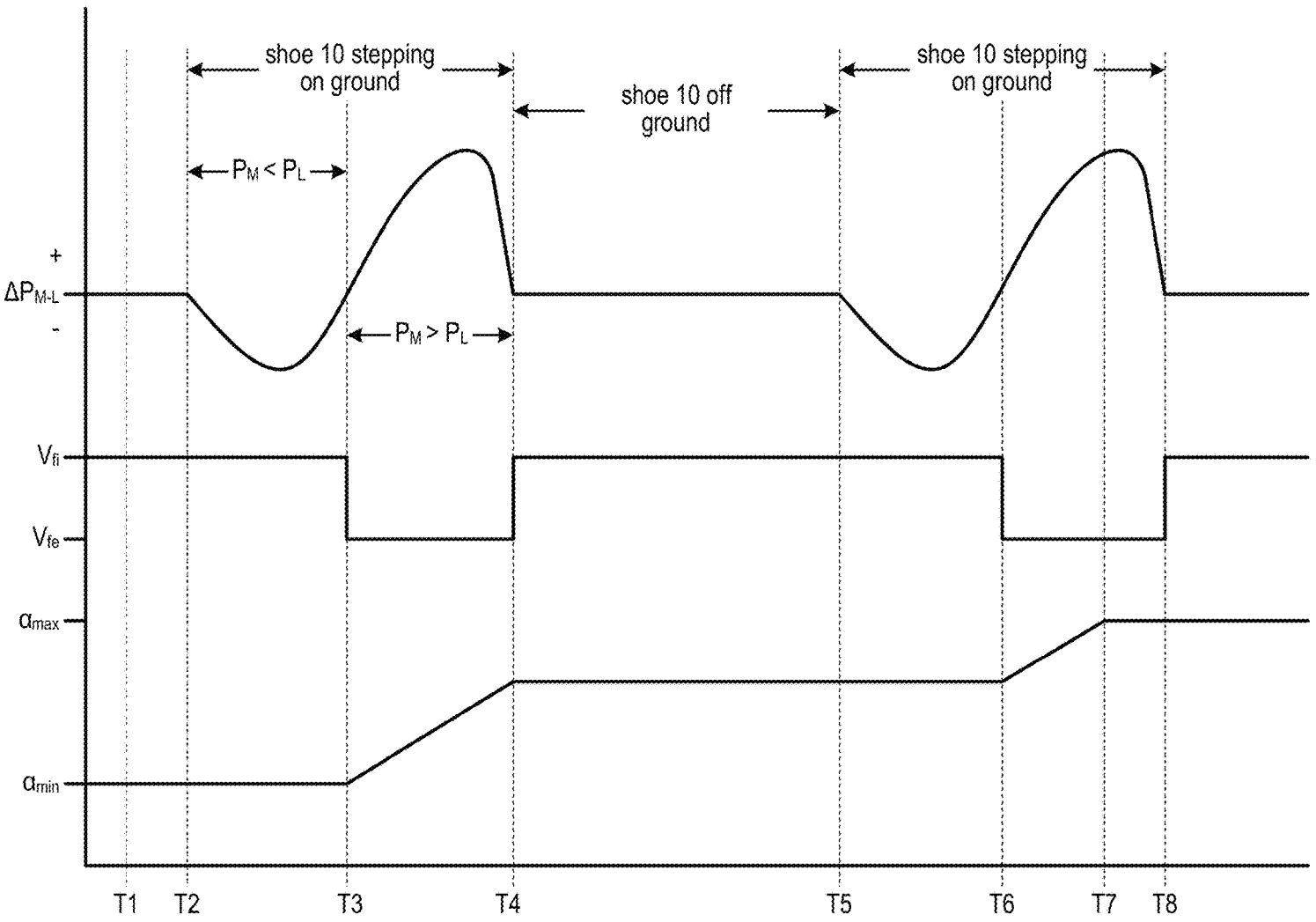
FIG. 11A is a graph of foot state, pressure difference, voltage levels, and incline angle at different times during a transition from a minimum incline condition to a maximum incline condition.

In some embodiments, a wearer of shoe 10 may be required to take several steps in order for top plate 41 to reach maximum incline. Accordingly, controller 47 may be configured to raise the voltage across electrodes 107 and 157 when controller 47 determines (based on data from IMU 213 and FSRs 31 and 32) that the wearer foot has left the ground. Controller 47 may then drop that voltage when it again determines that shoe 10 is stepping on the ground and $\Delta P_{M-L}$ is positive. This can be repeated for a predetermined number of steps. This is illustrated in FIG. 11A, a graph of medial-lateral pressure difference $\Delta P_{M-L}$, voltage across electrodes 107 and 157, and incline angle $\alpha$ at different times during a transition from a minimum incline condition to a maximum incline condition.

At time T1, controller 47 determines that top plate 41 of shoe 10 should transition to the maximum incline condition. At time T2, controller 47 determines that shoe 10 is stepping on the ground, but that $\Delta P_{M-L}$ is negative. At time T3, controller 47 determines that shoe 10 is stepping on the ground and that $\Delta P_{M-L}$ is positive, and controller reduces the voltage across electrodes 107 and 157 to $V_{fe}$. As a result, incline angle $\alpha$ of top plate 41 begins to increase from $\alpha_{min}$. At time T4, controller 47 determines that shoe 10 is no longer stepping on the ground, and controller raises the voltage across electrodes 107 and 157 to $V_{fi}$. As a result, incline angle $\alpha$ holds at its current value. At time T5, controller 47 again determines that shoe 10 is stepping on the ground, but that $\Delta P_{M-L}$ is negative. At time T6, controller 47 determines that shoe 10 is stepping on the ground and that $\Delta P_{M-L}$ is positive, controller 47 again reduces the voltage across electrodes 107 and 157 to $V_{fe}$, and incline angle $\alpha$ resumes increasing. At time T7, incline angle $\alpha$ reaches $\alpha_{max}$. Incline angle $\alpha$ stops increasing because further tilting of top plate 41 is prevented by medial stop 83. At time T8, controller 47 determines that shoe 10 is no longer stepping on the ground, and controller 47 again raises the voltage across electrodes 107 and 157 to $V_{fi}$. Controller 47 maintains that voltage at $V_{fi}$ through further step cycles until controller 47 determines that top plate 41 should transition to the minimum incline condition.

Figure 11B:
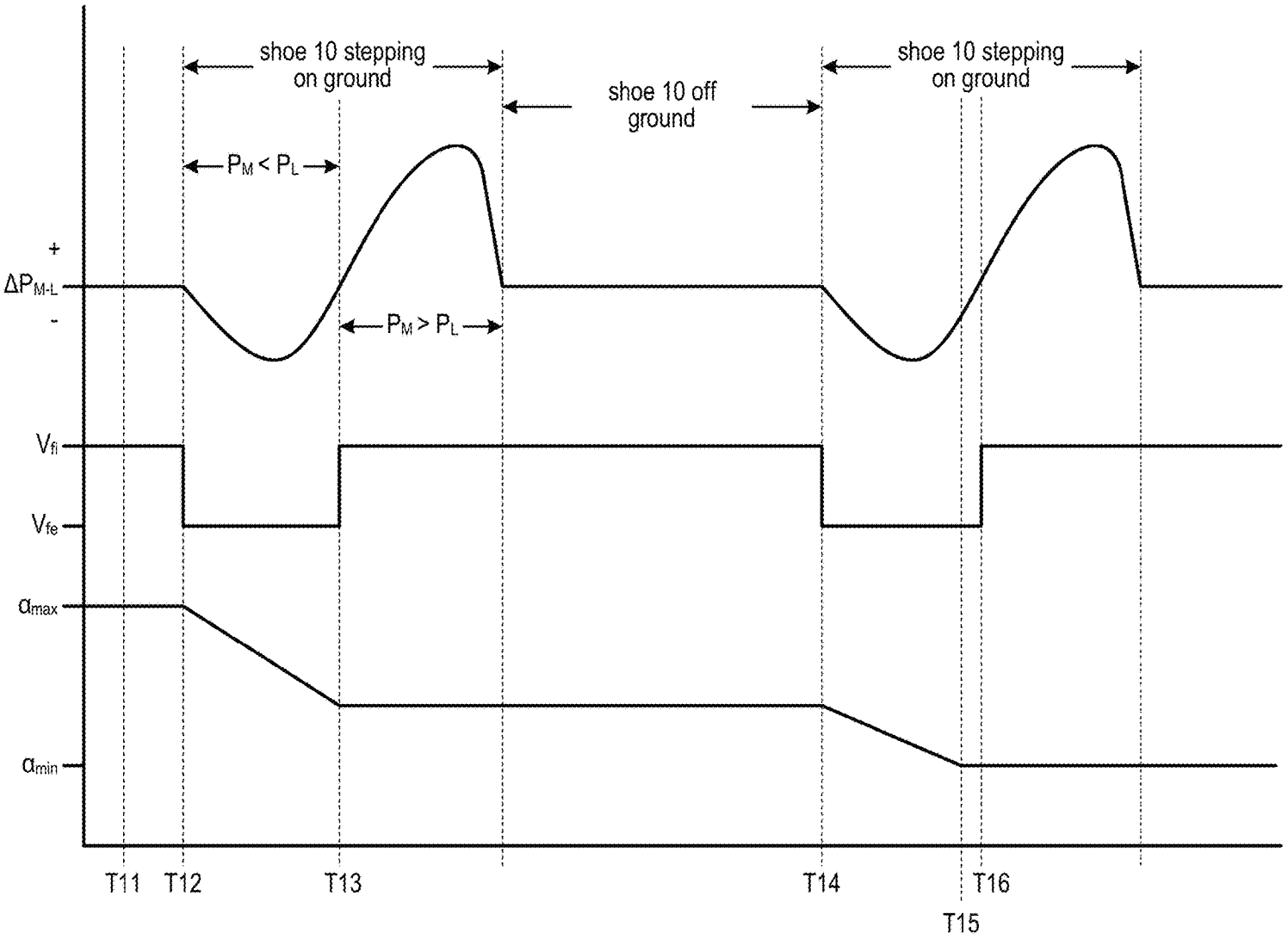
FIG. 11B is a graph of foot state, pressure difference, voltage levels, and incline angle at different times during a transition from a maximum incline condition to a minimum incline condition.

FIG. 11B is a graph of medial-lateral pressure difference $\Delta P_{M-L}$, voltage across electrodes 107 and 157, and incline angle $\alpha$ at different times during a transition from a maximum incline condition to a minimum incline condition. At time T11, controller 47 determines that top plate 47 of shoe 10 should transition to the minimum incline condition. At time T12, controller 47 determines that shoe 10 is stepping on the ground and that $\Delta P_{M-L}$ is negative, and controller 47 decreases the voltage across electrodes 107 and 157 to $V_{fe}$. As a result, and because a negative $\Delta P_{M-L}$ represents a pressure $P_{lat}$ in lateral chamber 35 that is higher than a pressure $P_{med}$ in medial chamber 36, ER fluid 59 begins to flow out of lateral chamber 35 and into medial chamber 36, and incline angle $\alpha$ begins to decrease from $\alpha_{max}$. At time T13, controller 47 determines that shoe 10 is stepping on the ground but that $\Delta P_{M-L}$ is positive, and controller 47 increases the voltage across electrodes 107 and 157 to $V_{fi}$. As a result, incline angle $\alpha$ of top plate 41 holds. At time T14, controller 47 determines that shoe 10 is again stepping on the ground and that $\Delta P_{M-L}$ is negative, and controller 47 lowers the voltage across electrodes 107 and 157 to $V_{fe}$. As a result, incline angle $\alpha$ continues to decrease. At time T15, incline angle $\alpha$ reaches $\alpha_{min}$. Incline angle $\alpha$ stops decreasing because further tilting of top plate 41 is prevented by lateral stop 82. At time T16, controller 47 determines that $\Delta P_{M-L}$ is positive, and controller 47 again increases the voltage across electrodes 107 and 157 to $V_{fi}$. Controller 47 maintains that voltage at $V_{fi}$ through further step cycles until controller 47 determines that top plate 41 should transition to the maximum incline condition.

In the above example, controller 47 lowered the voltage across electrodes 107 and 157 during two step cycles to transition between incline conditions. In other embodiments, however, controller 47 may lower that voltage during fewer or more step cycles. The number of step cycles to transition from minimum incline to maximum incline may not be the same as the number of step cycles to transition from maximum incline to minimum incline.

In some embodiments, controller 47 makes the determination of when to transfer to maximum incline position by counting the number of steps taken since initialization, and determining if that number of steps is enough to have located the shoe 10 wearer in a portion of a track bend. Typically, track athletes are very consistent in the lengths of their strides. Track dimensions and distances from the starting line to the bends in each track lane are known quantities that can be stored by controller 47. Based on input from a shoe 10 wearer to controller 47 indicating the track lane assigned to that shoe 10 wearer, as well as input indicating the length of that wearer's stride, controller 47 can determine the wearer's track location by keeping a running count of steps taken. As discussed above, controller 47 can determine where shoe 10 may be within a gait cycle based on data from IMU 213. These gait cycle determinations can indicate when a step has been taken.

In some embodiments, a left shoe of the pair that includes shoe 10 may operate in a manner similar to that described above for shoe 10, but with a maximum incline condition representing a maximum inclination of the left shoe top plate toward the lateral side. Operations performed by the left shoe controller would be similar to those described above in connection with FIGS. 11A through 11B, in which determinations were based on the sign of $\Delta P_{M-L}$, but instead basing determinations on the sign of $\Delta P_{L-M}=P_L-P_M$, where $P_L$ is a pressure in the left shoe lateral fluid chamber and $P_M$ is a pressure in the left shoe medial fluid chamber.

In some embodiments, a shoe controller may determine when to transition from minimum incline to maximum incline, and vice versa, based on other types of inputs. In some such embodiments, for example, a shoe wearer may wear a garment that includes one or more IMUs located on the wearer's torso and/or at some other location displaced from the shoe. Output of those sensors could be communicated to the shoe controller over a wireless interface similar to wireless module 212 (FIG. 9). Upon receiving output from those sensors indicating that the wearer has assumed a body position consistent with a need to incline a shoe top plate (e.g., as the wearer's body tilts to the side when running on a track bend), the controller can perform operations to incline a shoe top plate. In still other embodiments, a shoe controller may determine location in some other manner (e.g., based on GPS signals).

A controller need not be located within a sole structure. In some embodiments, for example, some or all components of a controller could be located with the housing of a battery assembly such as battery assembly 13 and/or in another housing positioned on a footwear upper.

Figure 12A:
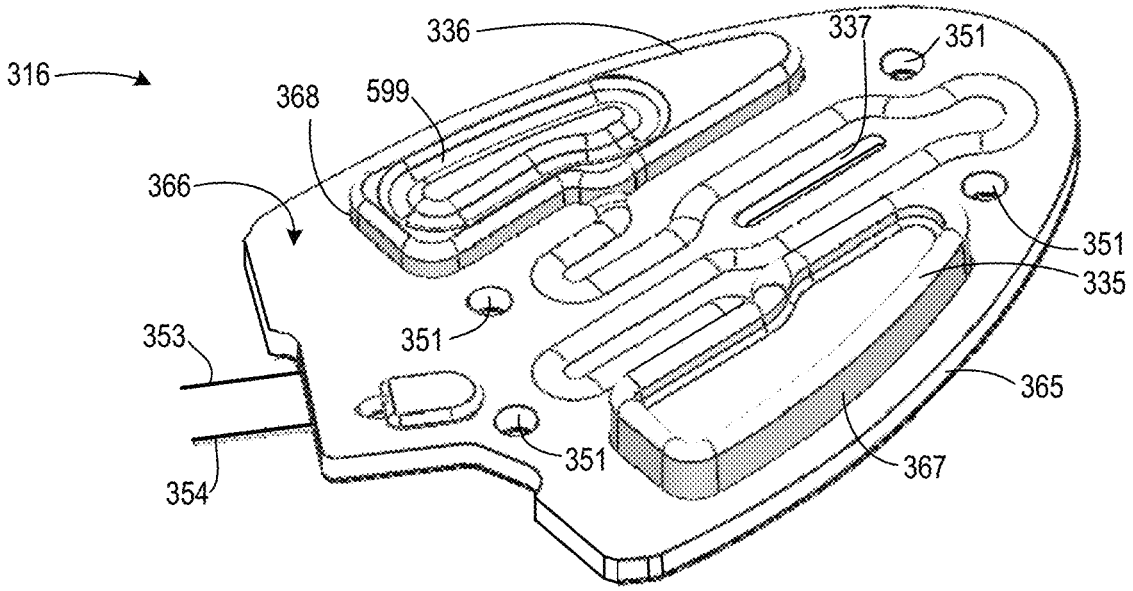
FIG. 12A is rear lateral top perspective view of an incline adjuster according to additional embodiments.
Figure 12B:
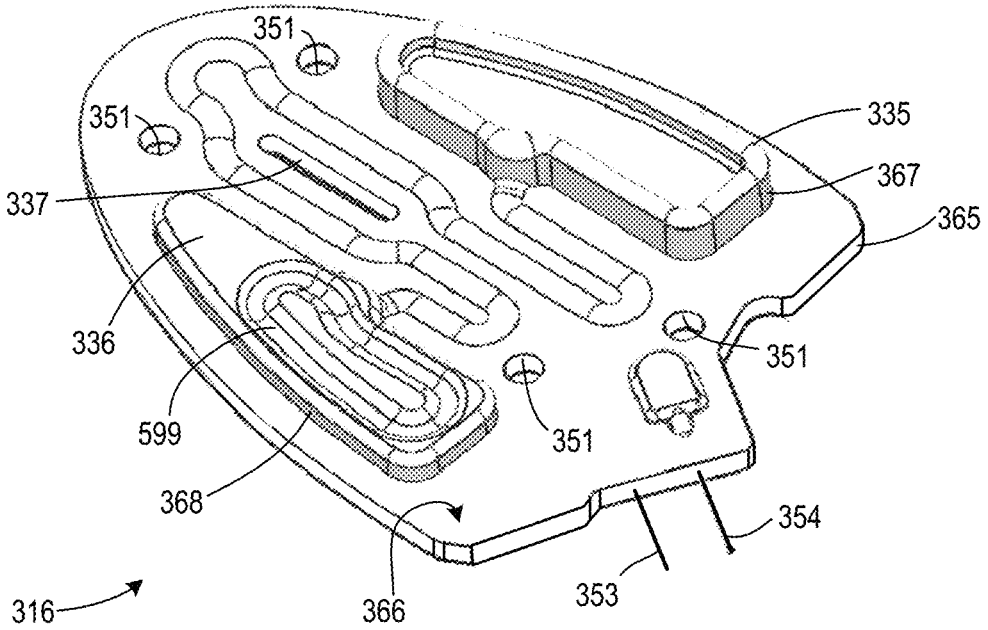
FIG. 12B is a rear medial top perspective view of the incline adjuster of FIG. 12A.
Figure 12C:
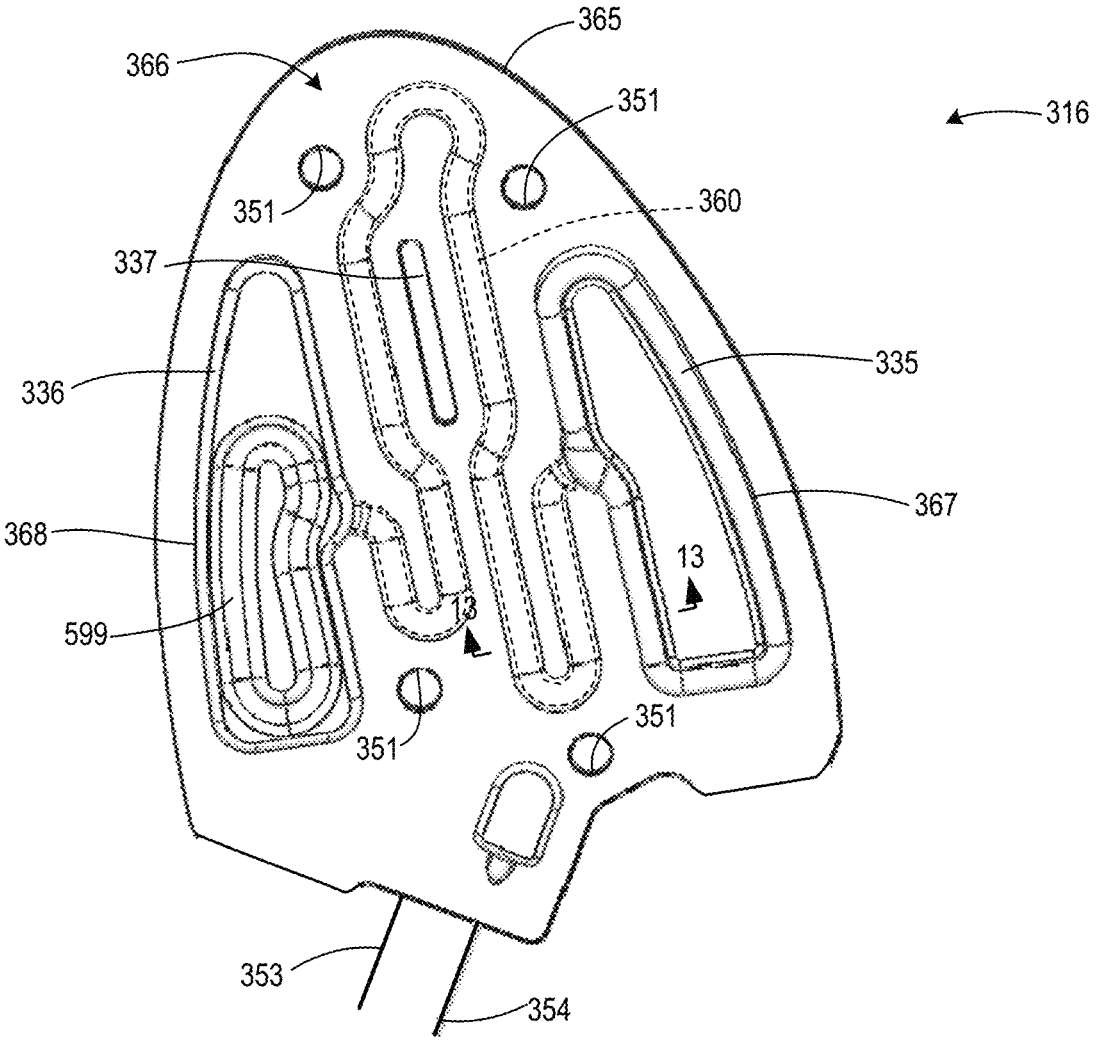
FIG. 12C is a top view of the incline adjuster of FIG. 12A.
Figure 13:
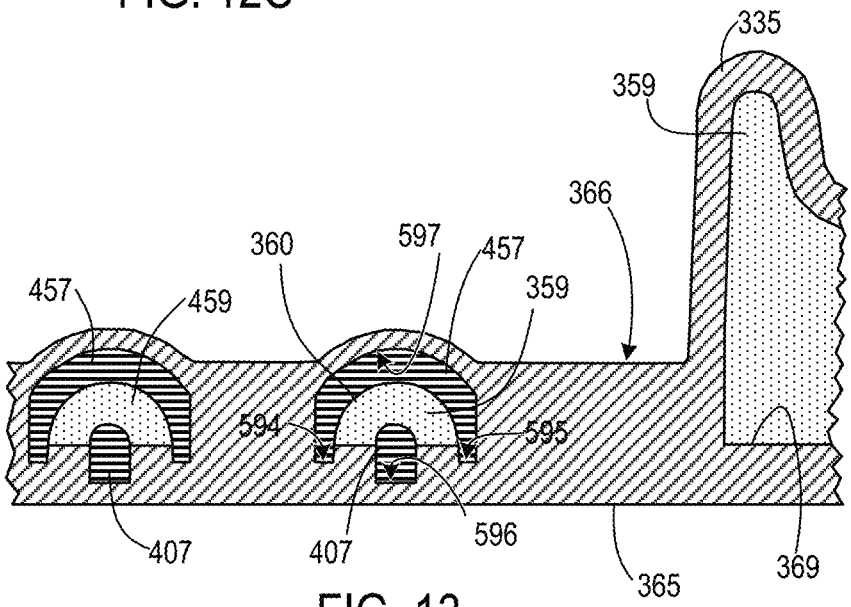
FIG. 13 is an enlarged area cross-sectional view taken from the plane indicated in FIG. 12C.

FIG. 12A is an enlarged rear lateral top perspective view of an incline adjuster 316 according to an additional embodiment. Incline adjuster 316 operates in a manner similar to that described above in connection with incline adjuster 16 and may be substituted for incline adjuster 16 in sole structure 12 of shoe 10. Except as pointed out below in more detail, incline adjuster 316 may have a structure that is the same as or similar to that of incline adjuster 16. FIG. 12B is an enlarged rear medial top perspective view of incline adjuster 316. FIG. 12C is an enlarged top view of incline adjuster 316. FIG. 13 is an enlarged area cross-sectional view taken from the plane indicated in FIG. 12C.

Figure 14:
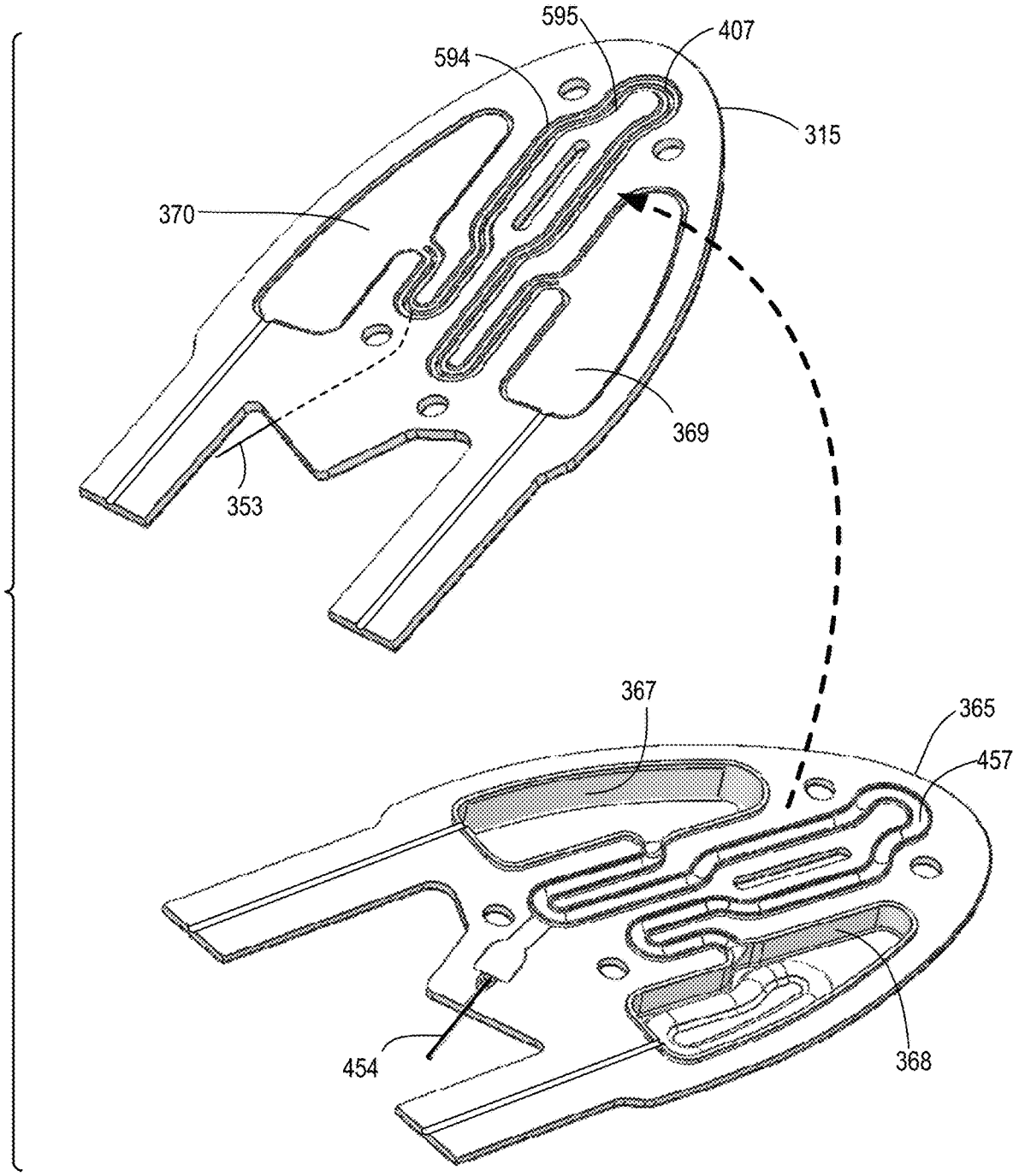
FIG. 14 shows assembly of the incline adjuster of FIGS. 12A-12C from separately formed first and second components.

Incline adjuster 316 includes a main body 365. A portion of a lateral chamber 335 is bounded by a flexible contoured wall 367 that extends upward from a lateral side of the top 366 of main body 365. Another portion of lateral chamber 335 bounded by a corresponding region 369 in main body 365 (FIG. 13). A portion of medial chamber 336 is bounded by a flexible contoured wall 368 that extends upward from a medial side of top side 366, with another portion of medial chamber 336 bounded by a corresponding region 370 in main body 365. Region 370 is not visible in FIGS. 12A-13, but is shown in FIG. 14 (discussed below).

Lateral chamber 335 is in fluid communication with medial chamber 336 through a fluid transfer channel 360 (FIG. 12C) defined in a central portion of main body 365 and extending between chambers 335 and 336. ER fluid 59 fills chambers 335 and 336 and transfer channel 360. A pair of opposing electrodes are positioned within transfer channel 360 and extend along a flow regulating portion of transfer channel 360. In the example of FIGS. 12A-13, the flow regulating portion is coextensive with the entirely of transfer channel 360. Leads 353 and 354 are in respective electrical contact with the bottom and top electrodes may be connected to converter 45.

Chamber 335 has a shape in the plane of main body 365 that is similar to that of chamber 35 in the plane of main body 65, but has a vertical contour that differs from that of chamber 35. In particular, the outer side sections of wall 367 do not include folds. Like chamber 35, however, chamber 335 includes a depression in its exterior shape. Similarly, chamber 336 has a shape in the plane of main body 365 that is similar to that of chamber 36 in the plane of main body 65, but has a vertical contour that differs from that of chamber 36. As with wall 367 of chamber 335, the outer side sections of wall 368 do not include folds. A top of chamber 336 is generally flat, but includes a trough 599 formed in one region.

Unlike incline adjuster 16, which includes electrodes 107 and 157 formed from metal sheet, incline adjuster 316 includes electrodes formed from conductive rubber. Moreover, the electrodes of incline adjuster 316 have cross-sectional profiles and relative positions that are different from those of electrodes 107 and 157. As seen in FIG. 13, the cross section of top electrode 457 generally has a shape of a "C" rotated 90 degrees clockwise. A concave inner side of the top electrode faces downward and forms top and side walls of transfer channel 360 along the flow regulating portion. An outer side of electrode 457, as well as small portions of the inner side of electrode 457 near the edges, are embedded in the material of main body 365 in grooves 594, 595, and 597. Bottom electrode 407 has a cross section that is generally that of a square joined to a half circle. A bottom portion of electrode 407 is embedded in the material of main body 365 in a groove 596. The portion of electrode 407 having the half-circle cross-sectional shape projects upward into transfer channel 360 and into the concavity of the concave inner side of electrode 457.

In some embodiments, the radius of the inner concave side of electrode 457 exposed to ER fluid 59 and the radius of the portion of electrode 407 projecting into the concavity are both circular and concentric so that the cross-sectional shape of transfer channel 60 is a half-annulus. In some such embodiments, values for the radius of the inner concave side of electrode 457 exposed to ER fluid 59 and the radius of the portion of electrode 407 projecting into the concavity are 1.5 mm and 0.5 mm, respectively. One example of a material from which electrodes 407 and 457 may be formed is the thermoplastic polyolefin elastomer (TEO) with embedded stainless steel fibers, sold by RTP Co. under the product designation EMI 2862-60A, having a Shore A hardness of 60, and having the following typical electrical properties: volume resistivity less than 1 ohms-cm (measured according to ASTM D 257), surface resistivity less than 10,000 ohms/square (measured according to ASTM D 257 and ESD STM11.11), surface resistance less than 1000 ohms (measured according to ESD STM11.11), and static decay (per MIL-PRF-81705D, 5 kV to 50 V, 12% RH) less than 2 seconds (measured according to FTMS101C 4046.1).

In other embodiments, an incline adjuster may be similar to incline adjuster 316 (and include electrodes similar to electrodes 407 and 457), but further include bellows-shaped chambers (e.g., similar to chamber 35 and 36 of incline adjuster 16). Alternatively, only one of the chambers in such an embodiment may include a bellows shape.

Incline adjuster 316 may be fabricated by separately forming a bottom component 315 and a top component 365, as shown in FIG. 14. The bottom component may include regions 369 and 370 of chambers 335 and 336, respectively, a bottom portion of transfer channel 360, and bottom electrode 407. The top component may include walls 367 and 368 of chambers 335 and 336, respectively, a top portion of transfer channel 360, and top electrode 457.

Bottom component 315 may be formed in a two-step injecting molding procedure. In the first step, a layer corresponding to bottom component 315 without electrode 407 is molded. In that layer, groove 596 (see FIG. 13) into which a portion of electrode 407 will be embedded is formed in the bottom portion of transfer channel 360. Grooves 594 and 595, into which edges of top electrode 457 will be placed during assembly, are formed at the edges of the bottom portion of transfer channel 360. Lead 353 may also be molded into that layer, with a portion of lead extending into groove 596 to contact lower electrode 407 once formed. In a second step of the injecting molding procedure, electrode 407 may be molded in place.

Top component 365 may also be formed in a two-step injecting molding procedure. In the first step, a layer corresponding to top component 365 without electrode 457 is molded. In that layer, a groove 597 (see FIG. 13) into which a portion of electrode 457 will be embedded is formed in the top portion of transfer channel 360. Lead 354 may also be molded into that layer, with a portion of lead extending into groove 597 to contact upper electrode 457 once formed. In a second step of the injecting molding procedure, electrode 457 may be molded in place.

After components 315 and 365 have been formed, a top side of bottom component 315 may be bonded to a bottom side of top component 365. Components 315 and 365 are assembled so that the bottom and top portions of transfer channel 360 are aligned to form transfer channel 360, and with edges of electrode 457 extending into grooves 594 and 595. Region 369 is aligned with the opening to the interior of the cavity bounded by wall 367 to form lateral chamber 335. Region 370 is aligned with the opening to the interior of the cavity bounded by wall 368 to form medial chamber 336. The alignment of components 315 and 365 during assembly may be performed in a manner similar to that described in connection with FIG. 7B. After assembly, contacting surfaces of the top side of component 315 and the bottom side of component 365 may be bonded using RF welding or chemical adhesive. An internal volume comprising internal volumes of chamber 335, chamber 336, and transfer channel 360 may then be filled with ER fluid 59, and the internal volume sealed, in a manner similar to that described in connection with incline adjuster 316.

The foregoing description of embodiments has been presented for purposes of illustration and description. The foregoing description is not intended to be exhaustive or to limit embodiments of the present invention to the precise form disclosed, and modifications and variations are possible in light of the above teachings or may be acquired from practice of various embodiments. The embodiments discussed herein were chosen and described in order to explain the principles and the nature of various embodiments and their practical application to enable one skilled in the art to utilize the present invention in various embodiments and with various modifications as are suited to the particular use contemplated. Any and all combinations, subcombinations and permutations of features from herein-described embodiments are the within the scope of the invention. In the claims, a reference to a potential or intended wearer or a user of a component does not require actual wearing or using of the component or the presence of the wearer or user as part of the claimed invention.

The invention claimed is:

1. An article comprising:

an incline adjuster comprising a main body, a variable-volume first chamber extending on a first side of the main body, and a variable-volume second chamber extending on a second side of the main body, wherein the first side of the main body is one of a medial and a lateral side of the main body and the second side is the other of the medial and the lateral side of the main body, and wherein the incline adjuster further comprises:

a transfer channel extending between the first chamber and the second chamber;

an electrorheological fluid filling the first chamber, the transfer channel, and the second chamber;

a first electrode exposed to the electrorheological fluid along the transfer channel; and a second electrode and exposed to the electrorheological fluid along the transfer channel in a position opposite the first electrode, wherein the first chamber comprises a first chamber wall central section and a first chamber wall side section surrounding the first chamber wall central section, and wherein the first chamber wall central section comprises an exterior shape that includes a depression, and wherein a concave side of the first electrode is exposed to the electrorheological fluid and a portion of the second electrode projecting into a concavity of the concave side is exposed to the electrorheological fluid.

2. The article of claim 1, wherein the first chamber wall side section comprises at least one fold defining a bellows shape.

3. The article of claim 1, wherein the second chamber comprises a second chamber wall central section and a second chamber wall side section surrounding the second chamber wall central section, and the second chamber has an exterior shape that includes a depression.

4. The article of claim 3, wherein the second chamber wall side section comprises at least one fold defining a bellows shape of the second chamber.

5. The article of claim 1, wherein the article is an article of footwear that comprises a sole structure, and the incline adjuster forms a part of a forefoot portion of the sole structure.

6. The article of claim 1, wherein a plate is located above the incline adjuster, rests on the first chamber and the second chamber, and is positioned so that downward force on the plate in a direction of the incline adjuster is transferred to the first chamber and the second chamber without being transferred to a central portion of the main body that extends between the first chamber and the second chamber.

7. The article of claim 1, wherein the first electrode and the second electrode each include a series of slots formed on side edges thereof, and wherein each slot is filled with a solid material forming a central portion of the main body.

8. The article of claim 1, further comprising a controller a voltage across the first electrode and the second electrode at one or more flow-inhibiting levels at which flow of the electrorheological fluid through the transfer channel is blocked, and a voltage across the first electrode and the second electrode at one or more flow-enabling levels permitting flow of the electrorheological fluid through the transfer channel.

9. The article of claim 8, wherein the article is part of an article of footwear, and wherein the controller is further configured to maintain a voltage across the first electrode and the second electrode at one or more flow-inhibiting levels in response to determining that the article of footwear has not traveled a first predetermined distance, and to maintain a voltage across the first electrode and the second electrode at one or more flow-enabling levels in response to determining that the article of footwear has travelled the first predetermined distance in response to determining that the article of footwear has travelled the first predetermined distance.

10. The article of claim 8, further comprising a voltage converter having an output to the first electrode and the second electrode, and wherein the voltage converter is configured to increase an input voltage to a higher voltage at the output and to be enabled and disabled by signals from the controller.

11. The article of claim 1, further comprising:

a bottom support plate positioned under the first and the second chambers;

a top support plate positioned above the first and the second chambers; and a fulcrum element positioned between the first and the second chambers and between the bottom support plate and the top support plate, wherein the fulcrum element is less compressible than the first and the second chambers when flow of electrorheological fluid through the transfer channel is permitted, and wherein the fulcrum element is positioned to provide a fulcrum for tilting of the top support plate relative to the bottom support plate as heights of the first and second chambers vary.

12. An article comprising:

an incline adjuster comprising a main body, a variable-volume lateral chamber extending on a lateral side of the main body, and a variable-volume medial chamber extending on a medial side of the main body, and wherein the incline adjuster further comprises:

a transfer channel extending between the lateral chamber and the medial chamber;

an electrorheological fluid filling the lateral chamber, the transfer channel, and the medial chamber;

a conductive rubber first electrode exposed to the electrorheological fluid along the transfer channel; and a conductive rubber second electrode exposed to the electrorheological fluid along the transfer channel, wherein a concave side of the first electrode is exposed to the electrorheological fluid, and a portion of the second electrode projecting into a concavity of the concave side is exposed to the electrorheological fluid.

13. The article of claim 12, wherein a path of the transfer channel extends along a nonlinear transfer channel path between the lateral chamber and the medial chamber, and wherein the first electrode and the second electrode each has a shape corresponding to a shape of the transfer channel path.

14. The article of claim 12, wherein a portion of the transfer channel over which both the first electrode and the second electrode extend has a length L and an average width W, and a ratio L/W is at least 50.

15. The article of claim 12, wherein the lateral chamber comprises a lateral chamber wall central section and a lateral chamber wall side section surrounding the lateral chamber wall central section, and the lateral chamber wall side section comprises at least one fold defining a bellows shape of the lateral chamber.

16. The article of claim 15, wherein the lateral chamber has an exterior shape that includes a depression.

17. The article of claim 12, wherein the medial chamber comprises a medial chamber wall central section and a medial chamber wall side section surrounding the medial chamber wall central section, and the medial chamber wall side section comprises at least one fold defining a bellows shape of the medial chamber.

18. The article of claim 17, wherein the medial chamber has an exterior shape that includes a depression.

19. The article of claim 12, wherein a plate is located above the incline adjuster, rests on the medial chamber and the lateral chamber, and is positioned so that downward force on the plate in a direction toward the incline adjuster is transferred to the medial chamber and the lateral chamber without being transferred to a central portion of the main body extending between the lateral chamber and the medial chamber.

20. The article of claim 12, wherein a plate is located above the incline adjuster and extends over the medial chamber, the lateral chamber, and central portion of the main body extending between the lateral chamber and the medial chamber, and the plate and incline adjuster are arranged so that downward force on the plate toward the incline adjuster does not compress a region of the central portion containing the first and second electrodes.

* * * * *